US006871690B2

(12) United States Patent
Sato et al.

(10) Patent No.: US 6,871,690 B2
(45) Date of Patent: Mar. 29, 2005

(54) CENTRIFUGAL CASTING EQUIPMENT

(75) Inventors: Hideshi Sato, Utsunomiya (JP); Shiro Naito, Utsunomiya (JP); Fumio Hirai, Utsunomiya (JP); Haruki Kodama, Imaichi (JP); Masayoshi Kai, Iruma (JP); Setsumi Hatanaka, Kawagoe (JP); Noboru Miyao, Tochigi-ken (JP); Takeshi Sasaki, Tochigi-ken (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/491,912

(22) PCT Filed: Sep. 26, 2002

(86) PCT No.: PCT/JP02/09938

§ 371 (c)(1),
(2), (4) Date: Apr. 8, 2004

(87) PCT Pub. No.: WO03/031097

PCT Pub. Date: Apr. 17, 2003

(65) Prior Publication Data

US 2004/0247733 A1 Dec. 9, 2004

(30) Foreign Application Priority Data

Oct. 9, 2001 (JP) ..... 2001-311884
Feb. 8, 2002 (JP) ..... 2002-032131

(51) Int. Cl.[7] ..... B22D 13/02; B22D 13/10

(52) U.S. Cl. ..... 164/298; 164/299

(58) Field of Search ..... 164/298–301; 425/425

(56) References Cited

U.S. PATENT DOCUMENTS 2,731,690 A 1/1956 Coupland, Jr. et al.
4,116,260 A * 9/1978 Pierrel ..... 164/295

FOREIGN PATENT DOCUMENTS

JP 57-94461 A 6/1982
JP 58-6752 A 1/1983
JP 59-94562 * 5/1984
JP 2002-178121 A 6/2002

* cited by examiner

*Primary Examiner*—Kuang Y. Lin
(74) *Attorney, Agent, or Firm*—Birch, Stewart, Kolasch & Birch, LLP

(57) ABSTRACT

A centrifugal casting apparatus has a workpiece withdrawal mechanism, a cleaning mechanism, and a facing material applying mechanism which are disposed parallel to each other on an axial side of a centrifugal casting mold, a unit drive mechanism for moving the workpiece withdrawal mechanism, the cleaning mechanism, and the facing material applying mechanism in unison with each other in the direction indicated by the arrow B across the axial direction indicated by the arrow A, and a pouring mechanism disposed in an opposite axial side of the centrifugal casting mold.

9 Claims, 20 Drawing Sheets

CENTRIFUGAL CASTING EQUIPMENT

TECHNICAL FIELD

The present invention relates to a centrifugal casting apparatus for casting a tubular member with a centrifugal casting mold and automatically pulling the cast tubular member from the centrifugal casting mold.

BACKGROUND ART

There is known a centrifugal casting process for rotating a cylindrical hollow mold about its own axis at a high speed to hold poured molten metal against the inner wall of the mold thereby to produce a hollow casting.

One known centrifugal casting apparatus which can be used to carry out the centrifugal casting process is disclosed in Japanese laid-open patent publication No. 57-94461, for example. As shown in FIG. 20 of the accompanying drawings, the disclosed centrifugal casting apparatus has a rotary mold 1, a pair of longitudinal guide rails 2 disposed axially on one side of the rotary mold 1, and a tube withdrawal device (not shown) disposed axially on the other side of the rotary mold 1.

A longitudinally movable carriage 3 is mounted on the longitudinal guide rails 2 for movement along the longitudinal guide rails 2 toward and away from the rotary mold 1. The longitudinally movable carriage 3 supports thereon a pair of transverse guide rails 4 extending perpendicularly to the longitudinal guide rails 2. When the longitudinally movable carriage 3 is disposed in a position remote from the rotary mold 1, the opposite ends of the transverse guide rails 4 are connected to respective pairs of shunting guide rails 5, 6.

A first transversely movable carriage 7 is disposed for movement on and between the shunting guide rails 5 and the transverse guide rails 4, and a second transversely movable carriage 8 is disposed for movement on and between the shunting guide rails 6 and the transverse guide rails 4. The first transversely movable carriage 7 supports a pouring device 9 thereon, and the second transversely movable carriage 8 supports thereon a brushing device (cleaning device) 10 and a spraying device 11 for spraying a facing material.

The disclosed centrifugal casting apparatus operates as follows: After a cast tube is pulled out of the rotary mold 1 by the non-illustrated tube withdrawal device, the longitudinally movable carriage 3 with the second transversely movable carriage 8 supported thereon is moved along the longitudinal guide rails 2 toward the rotary mold 1. At this time, the rotary mold 1 is rotated about its own axis, and the brushing device 10 on the second transversely movable carriage 8 brushes the inner wall surface of the rotary mold 1.

Then, while the longitudinally movable carriage 3 is moving away from the rotary mold 1, the spray device 11 on the second transversely movable carriage 8 sprays a facing material to coat the inner wall surface of the rotary mold 1. After the inner wall surface of the rotary mold 1 has been coated, the second transversely movable carriage 8 is retracted from the transverse guide rails 4 onto the shunting guide rails 6, and the first transversely movable carriage 7 is moved from the shunting guide rails 5 onto the transverse guide rails 4.

The longitudinally movable carriage 3 with the first transversely movable carriage 7 supported thereon is moved along the longitudinal guide rails 2 toward the rotary mold 1. The pouring device 6 mounted on the first transversely movable carriage 7 then pours a molten metal into the rotary mold 1. Then, the rotary mold 1 is rotated about its own axis to form and solidify the molten metal into a cast tube, which is subsequently pulled out of the rotary mold 1 by the tube withdrawal device.

The disclosed centrifugal casting apparatus is disadvantageous in that since the brushing device 10, the spraying device 11, and the pouring device 9 are disposed parallel to each other on axially one side of the rotary mold 1, the brushing device 10 and the spraying device 11 are susceptible to the heat of the pouring device 9, and hence their positioning accuracy tends to be lowered. Particularly if the cast tube is small in diameter and long, then the brushing device 10 and the spraying device 11 are liable to interfere with the pouring device 9.

The tube withdrawal device which is disposed axially on the other side of the rotary mold 1 is relatively long compared with the axial length of the rotary mold 1. Therefore, the centrifugal casting apparatus takes up a relatively large installation space and is poorly space efficient.

In order to perform an efficient centrifugal casting process, it is necessary in some applications to use two or more rotary molds 1 at the same time, each combined with the brushing device 10, the spraying device 11, the pouring device 9, and the tube withdrawal device. Such a scheme is problematic in that the entire facility needs a considerably large installation space and is highly costly to install and run.

DISCLOSURE OF THE INVENTION

It is a major object of the present invention to provide a centrifugal casting apparatus which can reliably avoid the thermal effect of a pouring mechanism and is of a simple and compact structure for efficiently performing a centrifugal casting process.

According to the present invention, a centrifugal casting apparatus includes a workpiece withdrawal mechanism, a cleaning mechanism, and a facing material applying mechanism disposed parallel to each other on an axial side of a centrifugal casting mold in an axial direction thereof, and a pouring mechanism disposed in an opposite axial side of the centrifugal casting mold. The workpiece withdrawal mechanism, the cleaning mechanism, and the facing material applying mechanism are movable in unison with each other in a direction across to the axial direction by a unit drive mechanism.

The workpiece withdrawal mechanism, the cleaning mechanism, and the facing material applying mechanism are not susceptible to the heat from the pouring mechanism, and their positioning accuracy can effectively be maintained with a simple arrangement. Since the workpiece withdrawal mechanism, the cleaning mechanism, and the facing material applying mechanism, which are relatively long, are juxtaposed on one axis side of the centrifugal casting mold, the centrifugal casting apparatus is not elongate in the axial direction of the centrifugal casting mold, and an installation space therefor is effectively utilized with ease.

According to the present invention, another centrifugal casting apparatus includes at least two centrifugal casting molds disposed parallel to each other in an axial direction, an operating unit on an axial side of the centrifugal casting molds in the axial direction, and a pouring mechanism disposed in an opposite axial side of the centrifugal casting molds. The operating unit comprises a workpiece withdrawal mechanism, a cleaning mechanism, and a facing material applying mechanism (each also referred to as a basic unit). At least one of the workpiece withdrawal mechanism, the cleaning mechanism, and the facing material applying mechanism is provided as two units.

For example, if two centrifugal casting molds are juxtaposed, then the operating unit includes a first cleaning mechanism, a workpiece withdrawal mechanism, a facing material applying mechanism, and a second cleaning mechanism which are successively juxtaposed in the order named on one axis side of the centrifugal casting molds. Therefore, a molten metal is poured into the first centrifugal casting mold, a cast workpiece is removed from the first centrifugal casting mold, the first centrifugal casting mold is cleaned, and a facing material is applied to the first centrifugal casting mold, in a successive sequence. At the same time that the facing material is applied to the first centrifugal casting mold, the second centrifugal casting mold is cleaned, a facing material is applied to the second centrifugal casting mold, a molten metal is poured into the second centrifugal casting mold, a cast workpiece is removed from the second centrifugal casting mold, in a successive sequence.

Therefore, centrifugal casting processes can efficiently be performed on the two centrifugal casting molds. Furthermore, the centrifugal casting apparatus has one facing material applying mechanism and one workpiece withdrawal mechanism less than a centrifugal casting apparatus having two centrifugal casting molds for performing centrifugal casting processes with respective dedicated sets of basic units. Consequently, an overall installation space for the centrifugal casting apparatus is effectively reduced, the cost of the equipment thereof is greatly lowered, and the centrifugal casting apparatus is economical.

If three centrifugal casting molds are juxtaposed, then the operating unit includes a first workpiece withdrawal mechanism, a first cleaning mechanism, a facing material applying mechanism, a second workpiece withdrawal mechanism, and a second cleaning mechanism which are successively juxtaposed in the order named on one axis side of the centrifugal casting molds.

Consequently, an installation space required by the equipment of the centrifugal casting apparatus is reduced, and the cost thereof is lowered. In operation, only the single operating unit needs to be moved with respect to the centrifugal casting molds. The cycle time of the centrifugal casting apparatus is much shorter than a centrifugal casting apparatus having three sets of basic units for the respective centrifugal casting molds, and the centrifugal casting apparatus can efficiently perform desired centrifugal casting processes.

The above and other objects, features, and advantages of the present invention will become more apparent from the following description when taken in conjunction with the accompanying drawings in which preferred embodiments of the present invention are shown by way of illustrative example.

BEST MODE FOR CARRYING OUT THE INVENTION

Figure 1:
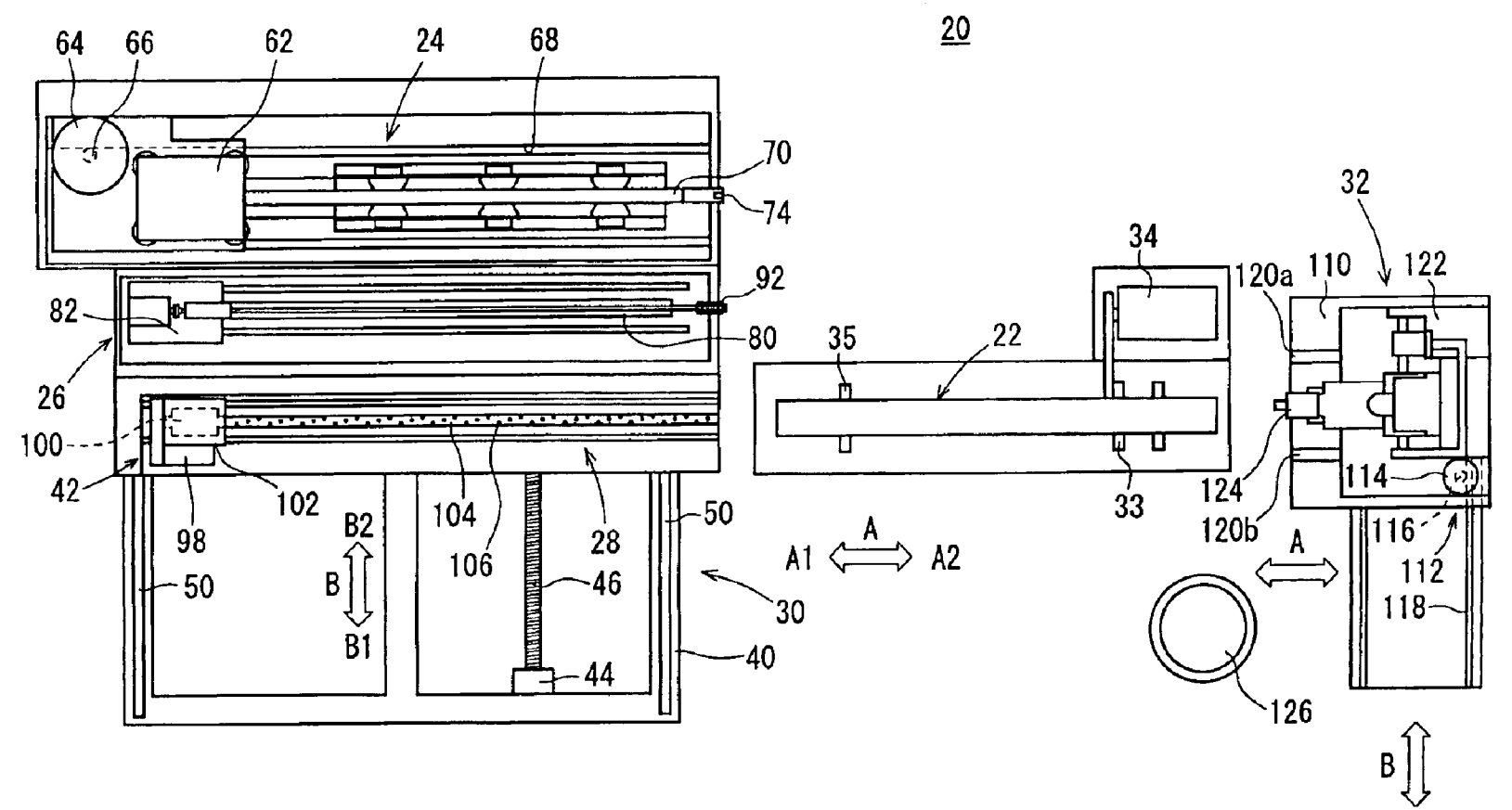
FIG. 1 is a schematic plan view of a centrifugal casting apparatus according to a first embodiment of the present invention.

FIG. 1 schematically shows in plan a centrifugal casting apparatus 20 according to a first embodiment of the present invention.

As shown in FIG. 1, the centrifugal casting apparatus 20 comprises a cylindrical centrifugal casting mold 22 disposed in a central position, a workpiece withdrawal mechanism 24, a cleaning mechanism 26, and a facing material applying mechanism 28 which are disposed parallel to each other on one axial side of the cylindrical centrifugal casting mold 22, i.e., in one direction (indicated by the arrow A1) of the axial direction (indicated by the arrow A) of the cylindrical centrifugal casting mold 22, a unit drive mechanism 30 for moving the workpiece withdrawal mechanism 24, the cleaning mechanism 26, and the facing material applying mechanism 28 in unison with each other in the direction indicated by the arrow B which extends across the axial direction A, and a pouring mechanism 32 disposed on the other axial side of the cylindrical centrifugal casting mold 22, i.e., in the other direction (indicated by the arrow A2) of the axial direction A of the cylindrical centrifugal casting mold 22.

The cylindrical centrifugal casting mold 22 is of a hollow shape elongate in the axial direction A, and has its opposite outer circumferential surfaces supported by a rotor 33 coupled to a rotary actuator 34 and a support 35, respectively, for rotation about its own axis.

Figure 2:
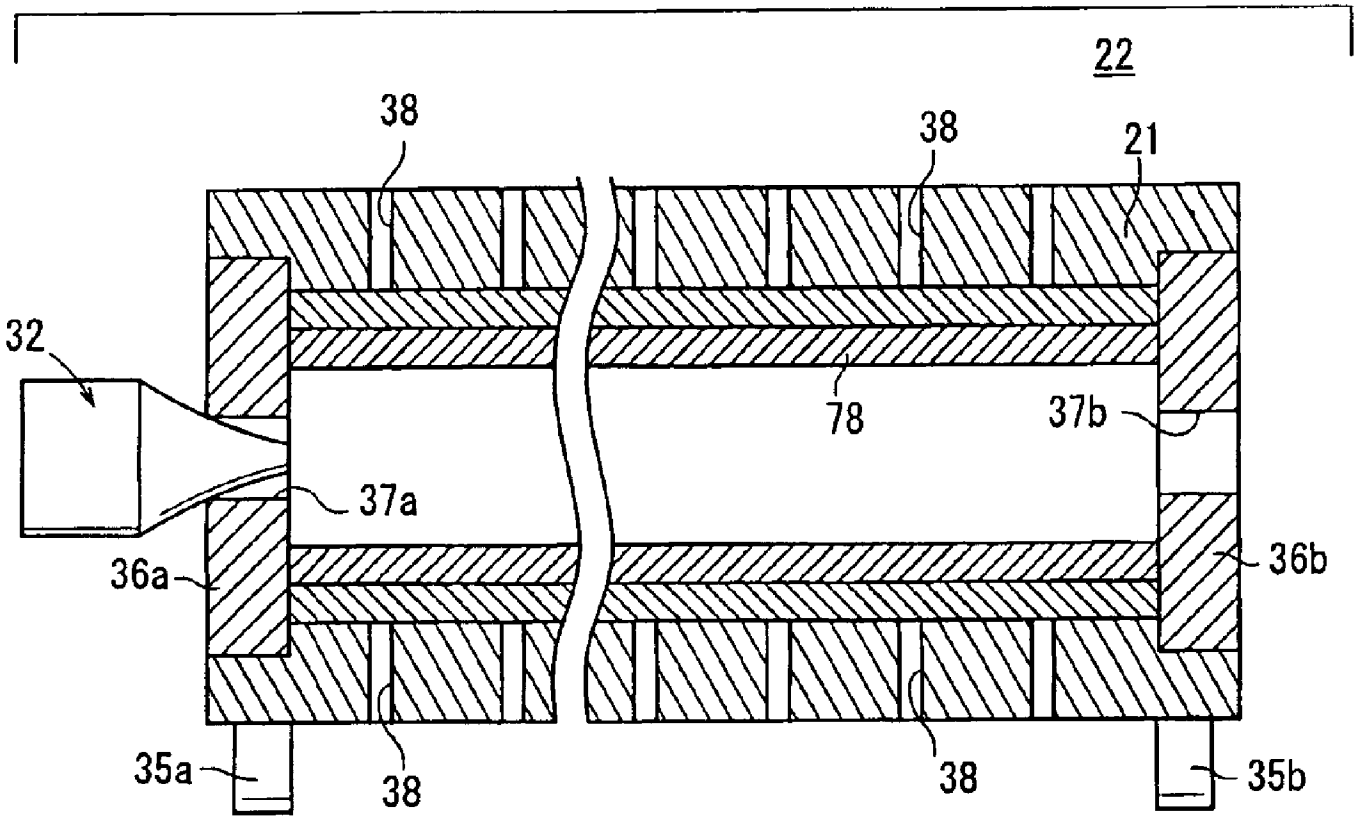
FIG. 2 is a cross-sectional view of a centrifugal casting mold of the centrifugal casting apparatus shown in FIG. 1.

As shown in FIG. 2, the cylindrical centrifugal casting mold 22 includes an outer mold frame 21 and has opposite open ends closed by respective lids 36*a*, 36*b* fitted therein. The lids 36*a*, 36*b* have respective through holes 37*a*, 37*b* defined therein and extending axially therethrough. The outer mold frame 21 has a plurality of radial passages 38 defined therein for passing cooling water therethrough for cooling the cylindrical centrifugal casting mold 22.

As shown in FIG. 1, the unit drive mechanism 30 has a frame 40 on which there is disposed a unit table 42 supporting thereon the workpiece withdrawal mechanism 24, the cleaning mechanism 26, and the facing material applying mechanism 28. The unit drive mechanism 30 also has a rotary actuator 44 such as a servomotor or the like fixedly mounted on the frame 40, and a ball screw 46 extending in the direction B and having an end coupled to the rotary actuator 44.

Figure 3:
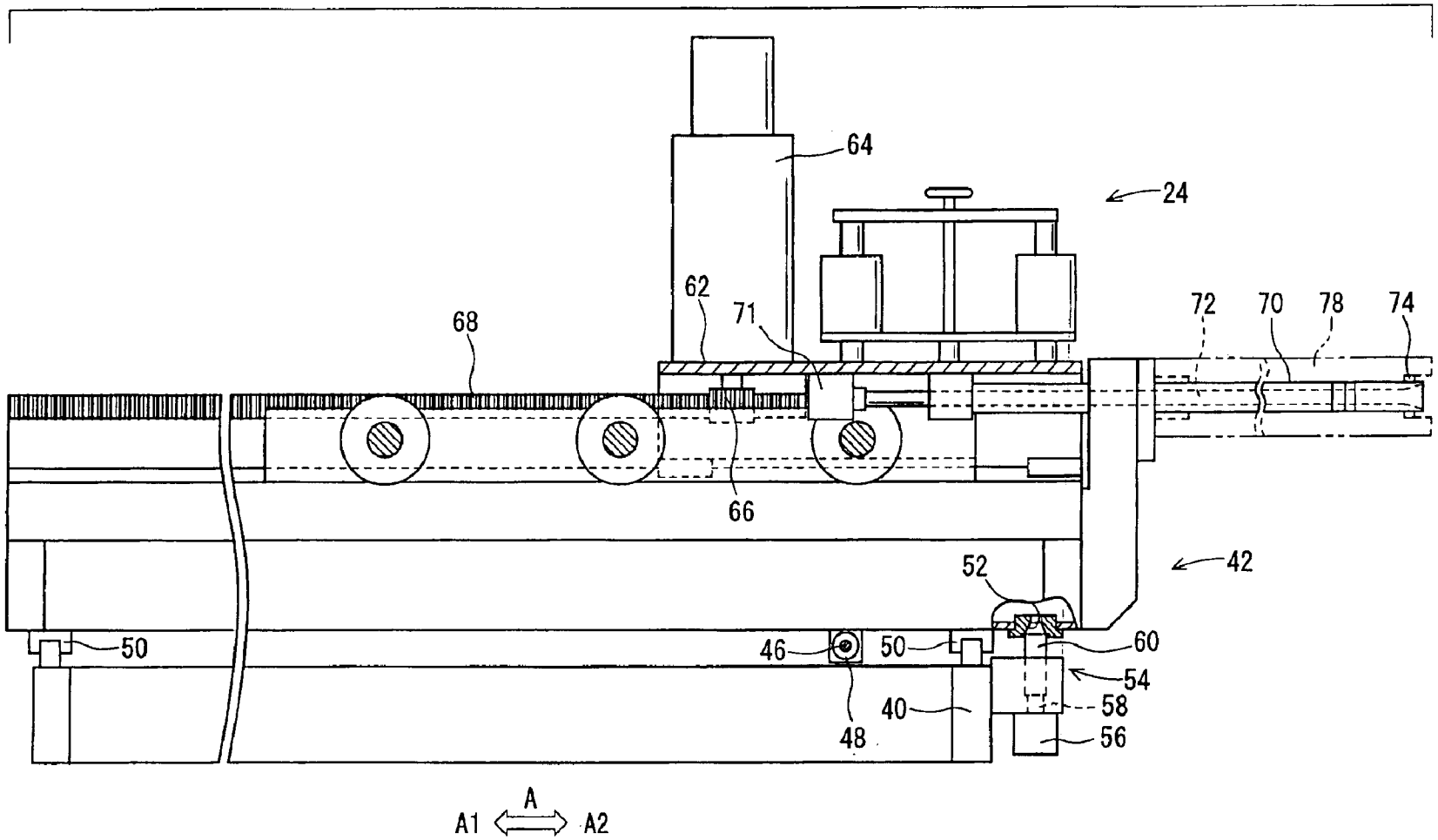
FIG. 3 is a side elevational view of a workpiece withdrawal device of the centrifugal casting apparatus shown in FIG. 1.
Figure 4:
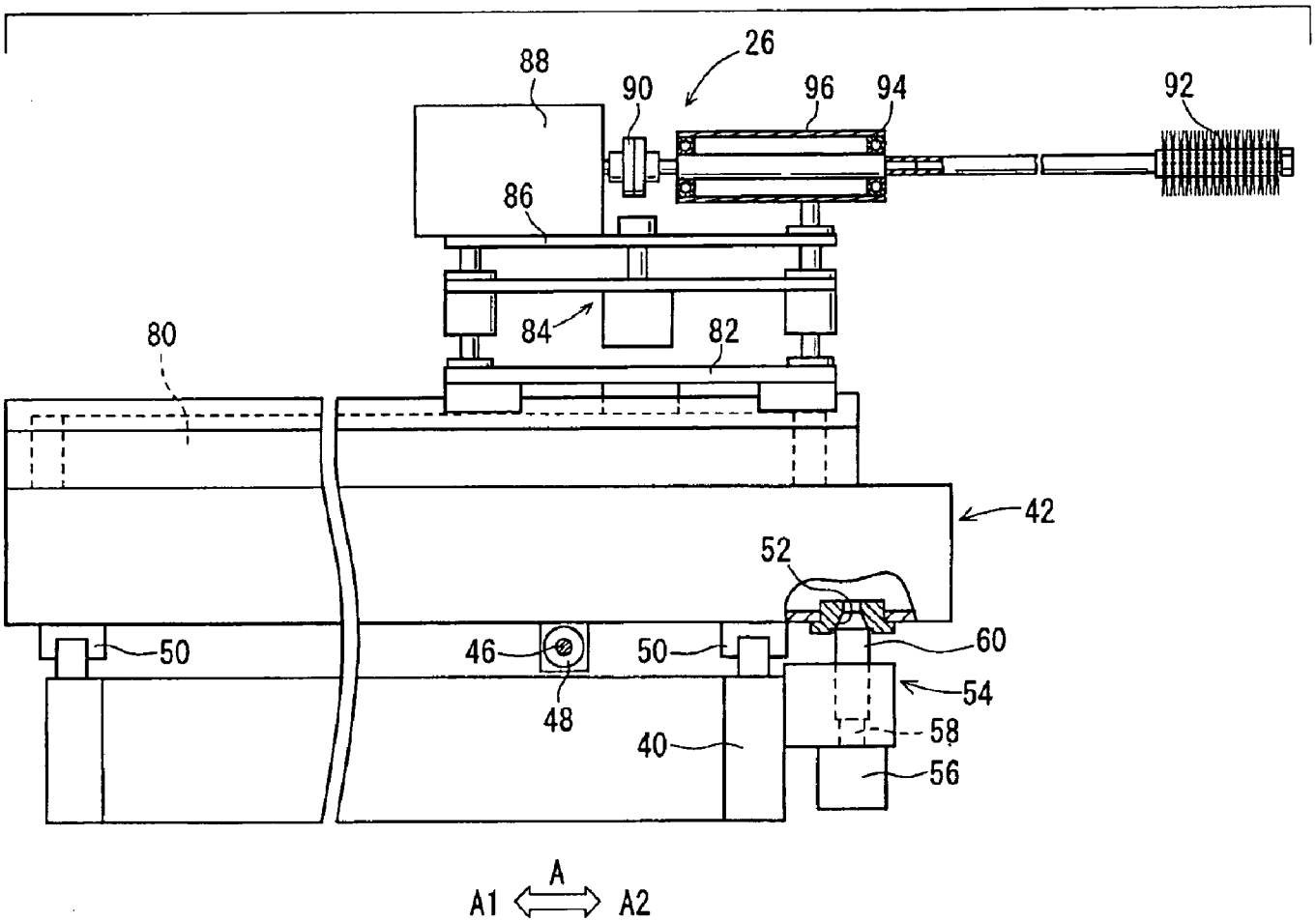
FIG. 4 is a side elevational view of a cleaning device of the centrifugal casting apparatus shown in FIG. 1.

As shown in FIGS. 3 and 4, the ball screw 46 is threaded through a nut 48 mounted on the lower surface of the unit table 42. The lower surface of the unit table 42 supports on its opposite ends two linear guides 50 extending parallel to the ball screw 46 and slidably engaging the frame 40 for guiding the unit table 42 over the frame 40.

The lower surface of the unit table 42 has three engaging holes 52 defined in an end thereof in the axial direction A2 for positioning the workpiece withdrawal mechanism 24, the cleaning mechanism 26, and the facing material applying mechanism 28, respectively, with respect to the cylindrical centrifugal casting mold 22. The frame 40 has an engaging unit 54 mounted on an end thereof at a position aligned with the cylindrical centrifugal casting mold 22. The engaging unit 54 includes a vertical cylinder 56 having an upwardly extending rod 58 axially coupled to an engaging pin 60 for selectively engaging in the engaging holes 52.

Alternatively, the unit drive mechanism 30 may comprise, rather than the ball screw structure described above, a rack mounted on the frame 40 and extending in the direction B and a rotary actuator mounted on the unit table 42 and having a pinion mounted on its output shaft in mesh with the rack.

As shown in FIGS. 1 and 3, the workpiece withdrawal mechanism 24 has a first movable base 62 mounted on the unit table 42 so as to be movable back and forth in the axial direction A. A first rotary actuator 64 is vertically fixedly mounted on the first movable base 62 and has a downwardly extending drive shaft on which there is mounted a pinion 66 held in mesh with a rack 68 that is mounted on the unit table 42 and extends in the axial direction A.

A cylindrical member 70 extending in the axial direction A is supported on the first movable base 62 and accommodates a drive rod 72 disposed for longitudinal movement therein. The drive rod 72 supports an openable/closable chuck 74 on its tip end in the axial direction A2. An opening and closing cylinder 71 is coupled to the tip end of the drive rod 72 in the axial direction A1. The cylindrical member 70 has its outer profile, dimensions, and axial length selected such that it can be inserted into a cylindrical casting 78 which is cast in the cylindrical centrifugal casting mold 22.

As shown in FIGS. 1 and 4, the cleaning mechanism 26 has a second movable base 82 which is movable back and forth in the axial direction A by an actuator 80 such as a rodless cylinder. A vertically movable plate 86 is mounted on the second movable base 82 by a lifter 84.

A rotary actuator 88 having a drive shaft 90 extending in the axial direction A2 is mounted on the vertically movable plate 86. A brush 92 which is elongate in the axial direction A is coupled at an end thereof to the drive shaft 90. The brush 92 has an end portion near the rotary actuator 88 rotatably supported by bearings 94 fitted in a tubular support 96 which is mounted on the vertically movable plate 86.

As shown in FIG. 1, the facing material applying mechanism 28 has a third movable base 102 movable back and forth in the axial direction A by a motor 98 through a ball screw mechanism 100 coupled thereto. The third movable base 102 supports thereon a small-diameter nozzle tube 104 which is elongate in the axial direction A. The nozzle tube 104 has a plurality of ejection ports 106 defined in its circumferential wall at spaced intervals.

The pouring mechanism 32 has a fourth movable base 110 movable back and forth in the direction B which extends perpendicularly across the axial direction A, by a drive mechanism 112. The drive mechanism 112 comprises a motor 114 fixedly mounted on the fourth movable base 110, a pinion 116 mounted on the drive shaft of the motor 114, and a rack 118 held in mesh with the pinion 116 and extending in the direction B. The rack 118 is secured to a stationary base. The above rack and pinion mechanism of the pouring mechanism 32 may be replaced with a ball screw mechanism.

Two parallel rails 120*a*, 120*b* extending in the axial direction A are mounted on the fourth movable base 110, and a slide base 122 is movably mounted on the rails 120*a*, 120*b*. The slide base 122 has a trough 124 for pouring a molten metal into the cylindrical centrifugal casting mold 22. The trough 124 is vertically positioned in alignment with the pouring height for the cylindrical centrifugal casting mold 22. A waste molten metal container 126 for receiving a waste molten metal discharged from the trough 124 is positioned within a range in which the fourth movable base 110 is movable in the direction B.

Figure 5:
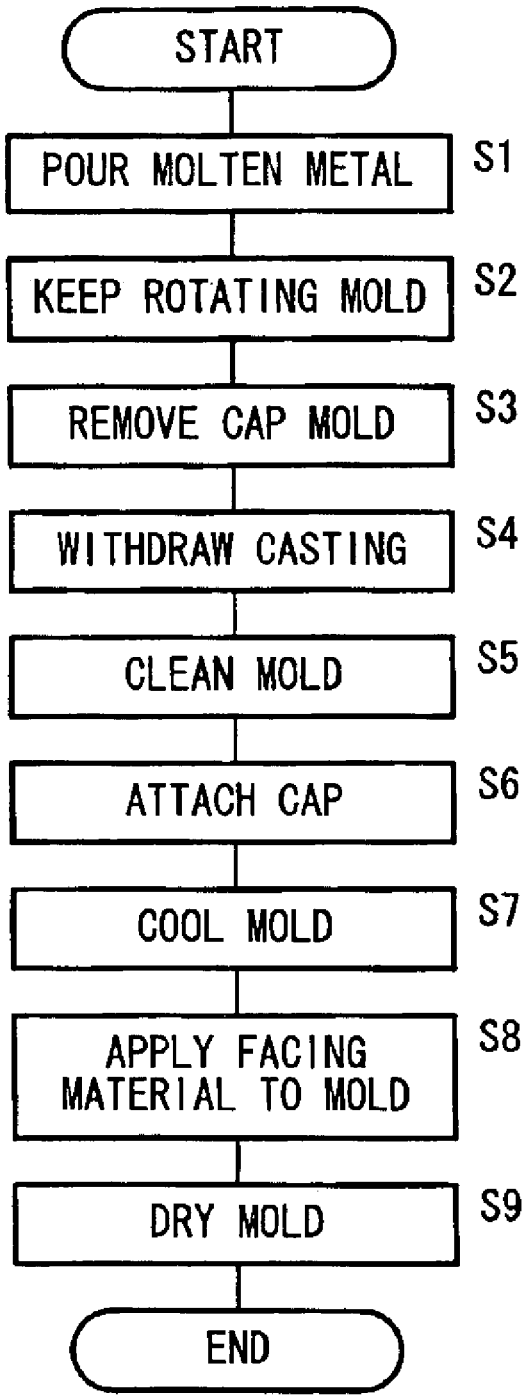
FIG. 5 is a flowchart of a centrifugal casting process carried out by the centrifugal casting apparatus shown in FIG. 1.

Operation of the centrifugal casting apparatus 20 thus constructed will be described below with reference to a flowchart in FIG. 5.

When the pouring mechanism 32 is supplied with a predetermined amount of molten metal, the slide base 122 of the pouring mechanism 32 is moved in the direction A1 to locate the trough 124 in a pouring position for the cylindrical centrifugal casting mold 22. After cooling water from a manifold (not shown) has passed through the passages 38, the trough 124 pours the molten metal into the cylindrical centrifugal casting mold 22 while the rotary actuator 34 is being energized in step S1. The slide base 122 is then retracted in the direction A2, and the cylindrical centrifugal casting mold 22 keeps being rotated by the rotor 33 and the support 35 in step S2. The molten metal in the cylindrical centrifugal casting mold 22 is solidified into a cylindrical casting 78 as shown in FIG. 2.

While the cylindrical centrifugal casting mold 22 is being rotated, a cap (not shown) is removed from the cylindrical centrifugal casting mold 22 in step S3. Then, the workpiece withdrawal mechanism 24 is moved. Specifically, the rotary actuator 44 of the unit drive mechanism 30 is energized to cause the ball screw 46 and the nut 48 to move the unit table 42 in the direction B1. When the workpiece withdrawal mechanism 24 reaches a position aligned with the cylindrical centrifugal casting mold 22, the unit table 42 is stopped.

As shown in FIG. 2, the cylinder 56 of the engaging unit 54 is actuated to lift the engaging pin 60 into the engaging hole 52 which is aligned with the workpiece withdrawal mechanism 24, thus positioning the unit table 42 with respect to the cylindrical centrifugal casting mold 22.

The rotary actuator 34 is then de-energized, and the rotary actuator 64 is energized to cause the pinion 66 and the rack 68 to move the first movable base 62 in the direction A2. The cylindrical member 70 mounted on the first movable base 62 is inserted into the cylindrical casting 78 which is cast in the cylindrical centrifugal casting mold 22, and moved in the direction A2 until the openable/closable chuck 74 is located at the tip end of the cylindrical casting 78 in the direction A2.

Then, the opening and closing cylinder 76 is actuated to cause the drive rod 72 to open the openable/closable chuck 74. The rotary actuator 64 is energized again to move the first movable base 62 in the direction A1. The openable/closable chuck 74 which is open engages the tip end of the cylindrical casting 78, and pulls the cylindrical casting 78 from the cylindrical centrifugal casting mold 22 in step S4.

A cooling rate for cooling the cylindrical casting 78 whose temperature is being lowered is determined in the vicinity of the transformation point A1. Specifically, when the molten metal is cooled and solidified and its temperature becomes lower than the eutectic point, the cylindrical casting 78 is removed from the cylindrical centrifugal casting mold 22 thereby to set the cooling rate for the cylindrical casting 78 to a range from 30 to 200° C./minute. The cylindrical casting 78 thus cooled has excellent machinability.

In a temperature range higher than the eutectic point, two phases, i.e., liquid and solid, are simultaneously present in the mold cavity. If the casting is removed from the mold in this temperature range, then since some of the molten metal flows out of the mold, it is not possible to obtain the cylindrical casting 78 which is of a complete shape. Stated otherwise, at temperatures lower than the eutectic point, the liquid phase disappears and only the solid phase composed of austenite and cementite is present in the mold cavity, no molten metal flows out of the mold when the cylindrical casting 78 is removed from the cylindrical centrifugal casting mold 22 in this temperature range. Therefore, it is possible to obtain the cylindrical casting 78 which is of a complete shape.

The cylindrical casting 78 is removed from the cylindrical centrifugal casting mold 22 immediately after its temperature drops below the eutectic point, and then cooled in an environment to set the cooling rate to the range from 30 to 200° C./minute.

As described above, the cylindrical casting 78 is removed from the cylindrical centrifugal casting mold 22 when the temperature of the cylindrical casting 78 drops below the eutectic point. In this manner, the cooling rate for the cylindrical casting 78 is controlled without the need for adjusting the temperature of the cooling water for cooling the cylindrical centrifugal casting mold 22. Accordingly, it is not necessary to perform a complex process of adjusting the temperature of the cooling water, and hence to provide a temperature adjusting mechanism for adjusting the temperature of the cooling water. The cost required to produce the cylindrical casting 78 is prevented from increasing.

When the temperature of the cylindrical casting 78 is further lowered and becomes lower than the transformation point $A_1$, ferrite and cementite are precipitated from the austenite, producing a lamellar structure of alternate layers of ferrite and cementite, i.e., pearlite.

The interlayer interval in the pearlite is in the range from 0.8 to 1.0 $\mu$m if the cooling rate upon passage through the transformation point A1 ranges from 30 to 200° C./minute. The cylindrical casting 78 with the above interlay interval exhibits good machinability.

The metal structure of the cylindrical casting 78 includes, in addition to the pearlite, graphite, ferrite, and steadite which is a ternary compound of Fe—$Fe_3C$—$Fe_3P$. If the cooling rate is set to the range described above, then the graphite forms a structure in which type A graphite and type B graphite according to ASTM (American Society for Testing and Materials) standards makes up 70% or more, and has a grain size ranging from class 4 to class 6 (ASTM standards). The proportion of the ferrite in the metal structure is 5% or less, and the proportion of the steadite in the metal structure ranges from 0.5 to 5%.

With the above graphite types and grain size and the above ferrite and steadite proportions, the machinability of the cylindrical casting 78 is better.

Consequently, the cylindrical casting 78 with good machinability can be produced according to the cylindrical casting process. Therefore, the machinability of the cylindrical casting 78 can be increased while its production efficiency is maintained.

If the cooling rate upon passage through the transformation point $A_1$ is lower than 30° C./minute, then since more ferrite and graphite will be contained in the metal structure, the produced cylindrical casting 78 will be lower in hardness and less resistant to wear. If the cooling rate upon passage through the transformation point A1 is higher than 200° C./minute, then the interlayer interval in the pearlite will be smaller than 0.8 $\mu$m, and the produced cylindrical casting 78 will be difficult to machine.

After the cylindrical casting 78 is withdrawn from the cylindrical centrifugal casting mold 22, the engaging pin 60 is released from the engaging hole 52, and the unit drive mechanism 30 is actuated to move the unit table 42 in the direction B2 to bring the cleaning mechanism 26 into alignment with the cylindrical centrifugal casting mold 22.

As shown in FIG. 4, the rodless cylinder 80 of the cleaning mechanism 26 is actuated to move the second movable base 82 in the direction A2 until the brush 92 enters the cylindrical centrifugal casting mold 22. The rotary actuator 88 is energized to rotate the brush 92 to clean the inner wall surface of the cylindrical centrifugal casting mold 22 in step S5.

After the brush 92 has cleaned the inner wall surface of the cylindrical centrifugal casting mold 22, the brush 92 is moved in the direction A1 away from the cylindrical centrifugal casting mold 22, and the cap (not shown) is attached to the cylindrical centrifugal casting mold 22 in step S6. The cylindrical centrifugal casting mold 22 is then cooled in step S7, and the facing material applying mechanism 28 is actuated.

As shown in FIG. 1, the unit table 42 is moved in the direction B2 to bring the facing material applying mechanism 28 into alignment with the cylindrical centrifugal casting mold 22. Thereafter, the motor 98 is energized to insert the nozzle tube 104 into the cylindrical centrifugal casting mold 22. A facing material (not shown) is ejected from the ejection ports 106 of the nozzle tube 104 and applied to the inner wall surface of the cylindrical centrifugal casting mold 22 in step S8.

Then, the nozzle tube 104 is removed from the cylindrical centrifugal casting mold 22, which is thereafter dried in step S9. The cylindrical centrifugal casting mold 22 can well be dried when it is rotated.

In the first embodiment, the workpiece withdrawal mechanism 24, the cleaning mechanism 26, and the facing material applying mechanism 28 are disposed parallel to each other on one axial side of the cylindrical centrifugal casting mold 22, i.e., in the direction A1, and the pouring mechanism 32 is disposed on the other axial side of the cylindrical centrifugal casting mold 22, i.e., in the direction A2.

Therefore, the workpiece withdrawal mechanism 24, the cleaning mechanism 26, and the facing material applying mechanism 28 are spaced from the pouring mechanism 32, and are not susceptible to the heat from the pouring mechanism 32. For casting the cylindrical casting 78 which is small in diameter and long in particular, therefore, the workpiece withdrawal mechanism 24, the cleaning mechanism 26, and the facing material applying mechanism 28 can be positioned accurately with respect to the cylindrical centrifugal casting mold 22. The centrifugal casting process can thus be performed efficiently with a simple arrangement.

The workpiece withdrawal mechanism 24, the cleaning mechanism 26, and the facing material applying mechanism 28, which are relatively long and mounted on the unit table 42, are oriented in the same direction and disposed parallel to each other, and the pouring mechanism 32, which is relatively short, is disposed alone. The centrifugal casting apparatus 20 is thus effectively short in the axial direction A, and an installation space therefor can easily be utilized effectively.

In the pouring mechanism 32, the waste molten metal container 126 is positioned within the range in which the fourth movable base 110 is movable in the direction B by the drive mechanism 112. When the molten metal in the pouring mechanism 32 is not poured into the cylindrical centrifugal casting mold 22, any waste molten metal can be quickly and automatically be discharged into the waste molten metal container 126 simply by moving the pouring mechanism 32 in the direction B. Therefore, the centrifugal casting process can easily be made efficient.

Figure 6:
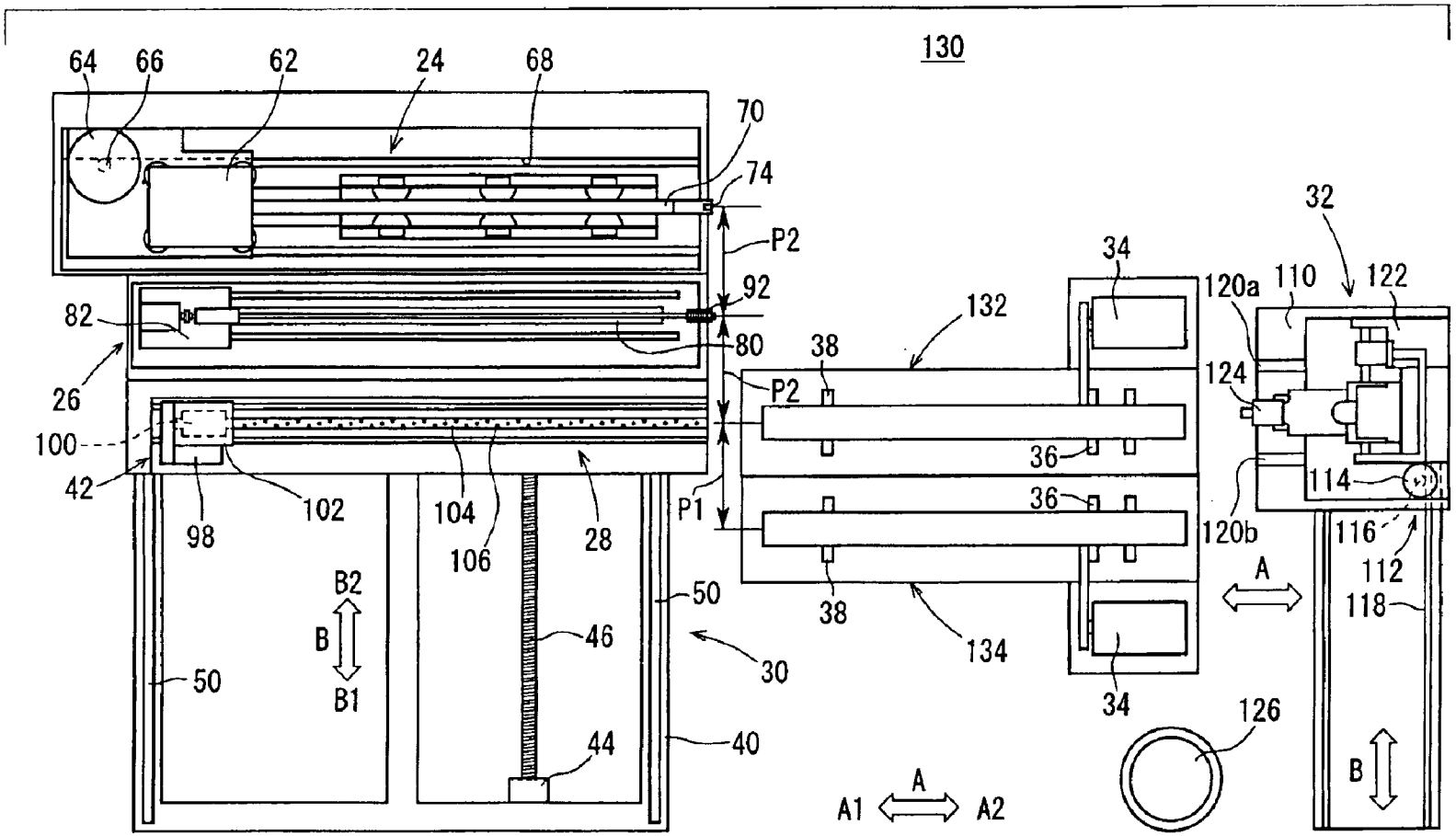
FIG. 6 is a schematic plan view of a centrifugal casting apparatus according to a second embodiment of the present invention.

FIG. 6 schematically shows in plan a centrifugal casting apparatus 130 according to a second embodiment of the present invention. Those parts of the centrifugal casting apparatus 130, and those parts of centrifugal casting apparatus according to third and fourth embodiments, to be described later on, which are identical to those of the centrifugal casting apparatus 20 according to the first embodiment are denoted by identical reference characters, and will not be described in detail below.

As shown in FIG. 6, the centrifugal casting apparatus 130 comprises first and second centrifugal casting molds 132, 134 which are axially parallel to each other in the axial direction A and juxtaposed in the direction B, a workpiece withdrawal mechanism 24, a cleaning mechanism 26, and a facing material applying mechanism 28 which are disposed parallel to each other on one axial side of the first and second centrifugal casting molds 132, 134, i.e., in the direction A1, a unit drive mechanism 30 for moving the workpiece withdrawal mechanism 24, the cleaning mechanism 26, and the facing material applying mechanism 28 in unison with each other in the direction B, and a pouring mechanism 32 disposed on the other axial side of the first and second centrifugal casting molds 132, 134, i.e., in the direction A2.

The first and second centrifugal casting molds 132, 134 are rotatable by respective rotary actuators 34. The first and second centrifugal casting molds 132, 134 are spaced from each other by an interval or distance P1 which is the same as an interval or distance P2 between adjacent two of the workpiece withdrawal mechanism 24, the cleaning mechanism 26, and the facing material applying mechanism 28.

Figure 7:
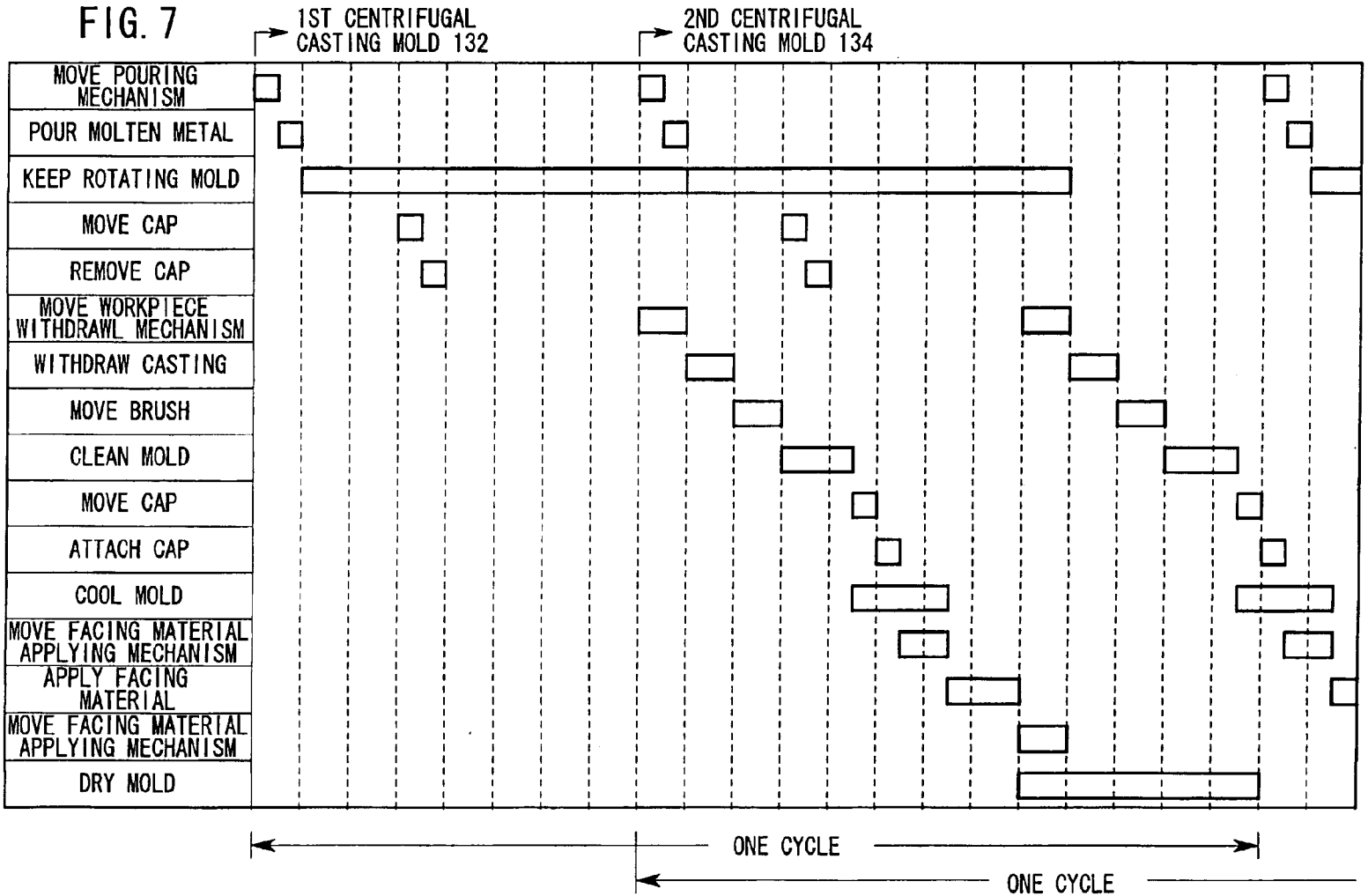
FIG. 7 is a diagram showing an operation program of the centrifugal casting apparatus shown in FIG. 6.

The centrifugal casting apparatus 130 is controlled to operate according to an operation program shown in FIG. 7. Specifically, the first and second centrifugal casting molds 132, 134 are operated according to the flowchart of FIG. 5 in essentially the same manner as the centrifugal casting mold 22 of the centrifugal casting apparatus 20 according to the first embodiment.

However, the centrifugal casting apparatus 130 differs from the centrifugal casting mold 22 as follows: Immediately before the maintained rotation of the first centrifugal casting mold 132 by the corresponding rotary actuator 34 is finished, the pouring mechanism 32 pours the molten metal into the second centrifugal casting mold 134.

Substantially at the same time that the maintained rotation of the first centrifugal casting mold 132 is finished, the second centrifugal casting mold 134 starts to be rotated by the corresponding rotary actuator 34. Then, various actions take place on the first and second centrifugal casting molds 132, 134.

According to the second embodiment, one cycle of operation of the second centrifugal casting mold 134 starts while one cycle of operation of the first centrifugal casting mold 132 is taking place. The overall efficiency of operation of the centrifugal casting apparatus 130 is thus effectively increased, and the overall casting cycles can easily be shortened.

As described above, the interval or distance P1 between the first and second centrifugal casting molds 132, 134 is equal to the distance P2 between adjacent two of the workpiece withdrawal mechanism 24, the cleaning mechanism 26, and the facing material applying mechanism 28. Therefore, the process of controlling the unit drive mechanism 30 is simplified, and the process of controlling the centrifugal casting apparatus 130 is not complicated.

Figure 8:
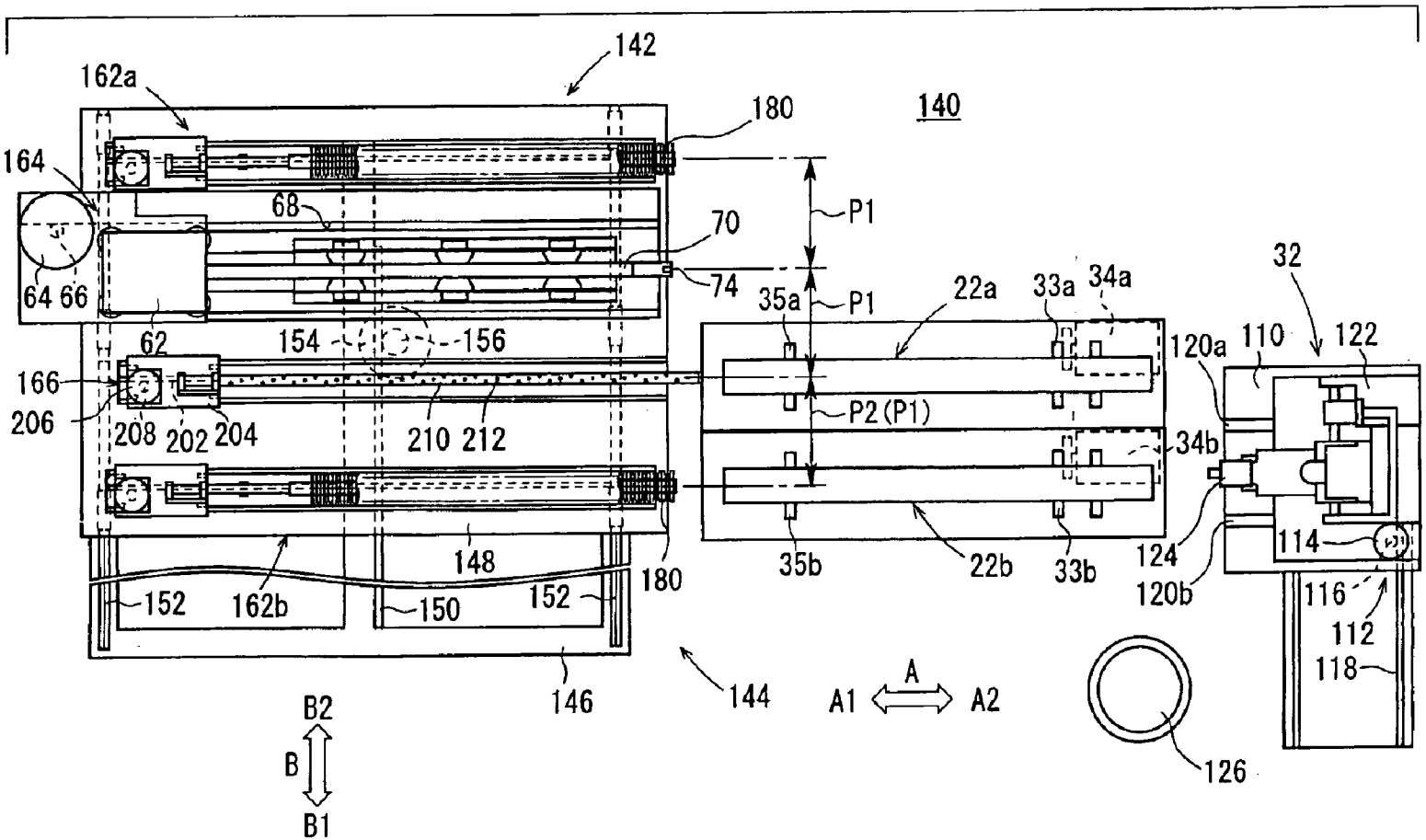
FIG. 8 is a schematic plan view of a centrifugal casting apparatus according to a third embodiment of the present invention.

FIG. 8 schematically shows in plan a centrifugal casting apparatus 140 according to a third embodiment of the present invention.

As shown in FIG. 8, the centrifugal casting apparatus 140 comprises first and second centrifugal casting molds 22*a*, 22*b* which are axially parallel to each other in the axial direction A and juxtaposed in the direction B, an operating unit 142 disposed on one axial side of the first and second centrifugal casting molds 22*a*, 22*b*, i.e., in the direction A1, a unit drive mechanism 144 for moving the operating unit 142 in the direction B, and a pouring mechanism 32 disposed on the other axial side of the first and second centrifugal casting molds 22*a*, 22*b*, i.e., in the direction A2.

The first and second centrifugal casting molds 22*a*, 22*b*, which are of a hollow shape elongate in the axial direction A, have opposite outer circumferential surfaces supported by respective rotors 33*a*, 33*b* coupled to respective rotary actuators 34*a*, 34*b* and respective support 35*a*, 35*b*, respectively, for rotation about their own axes.

Figure 9:
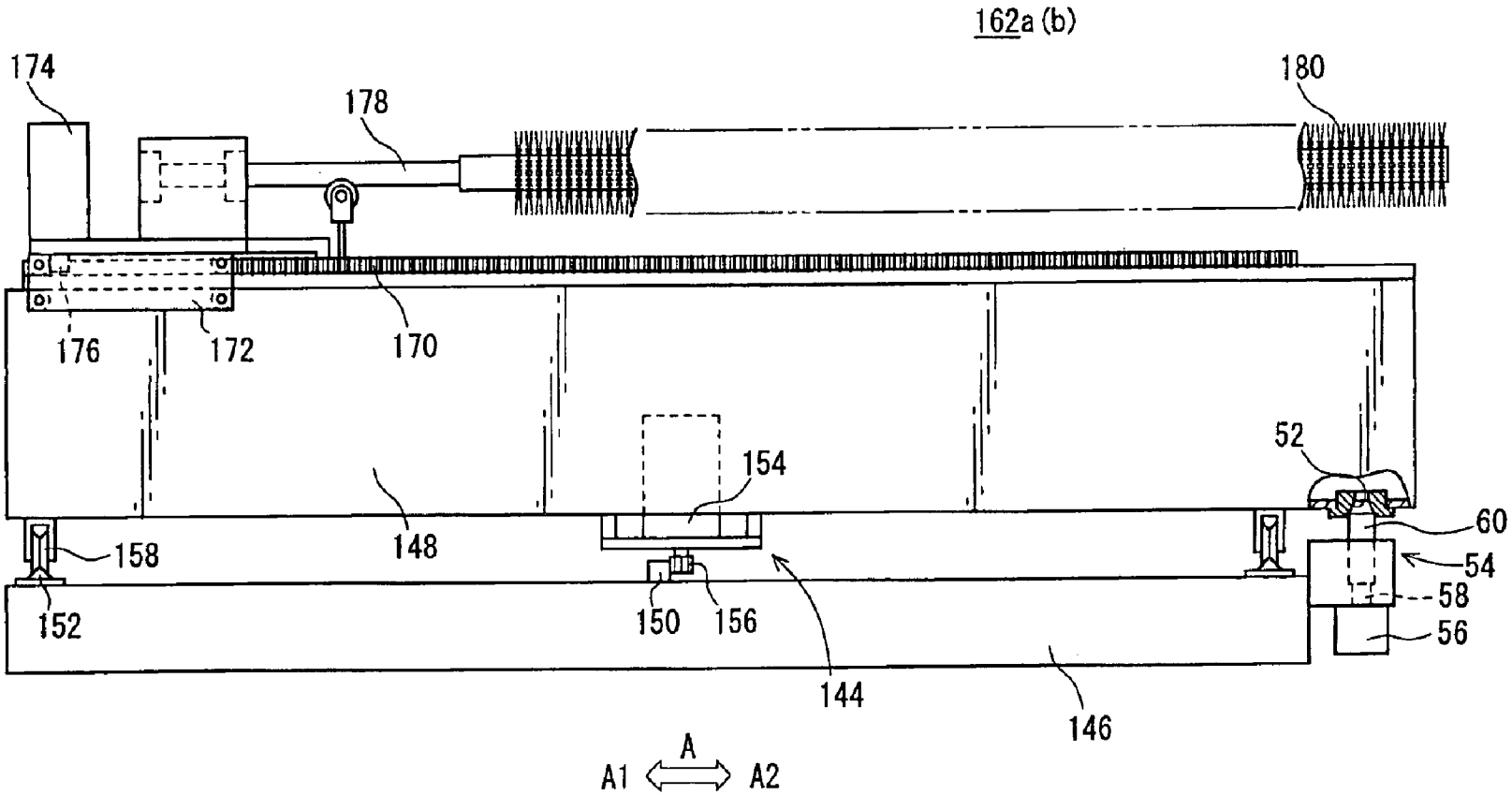
FIG. 9 is a side elevational view of a cleaning device of the centrifugal casting apparatus shown in FIG. 8.
Figure 10:
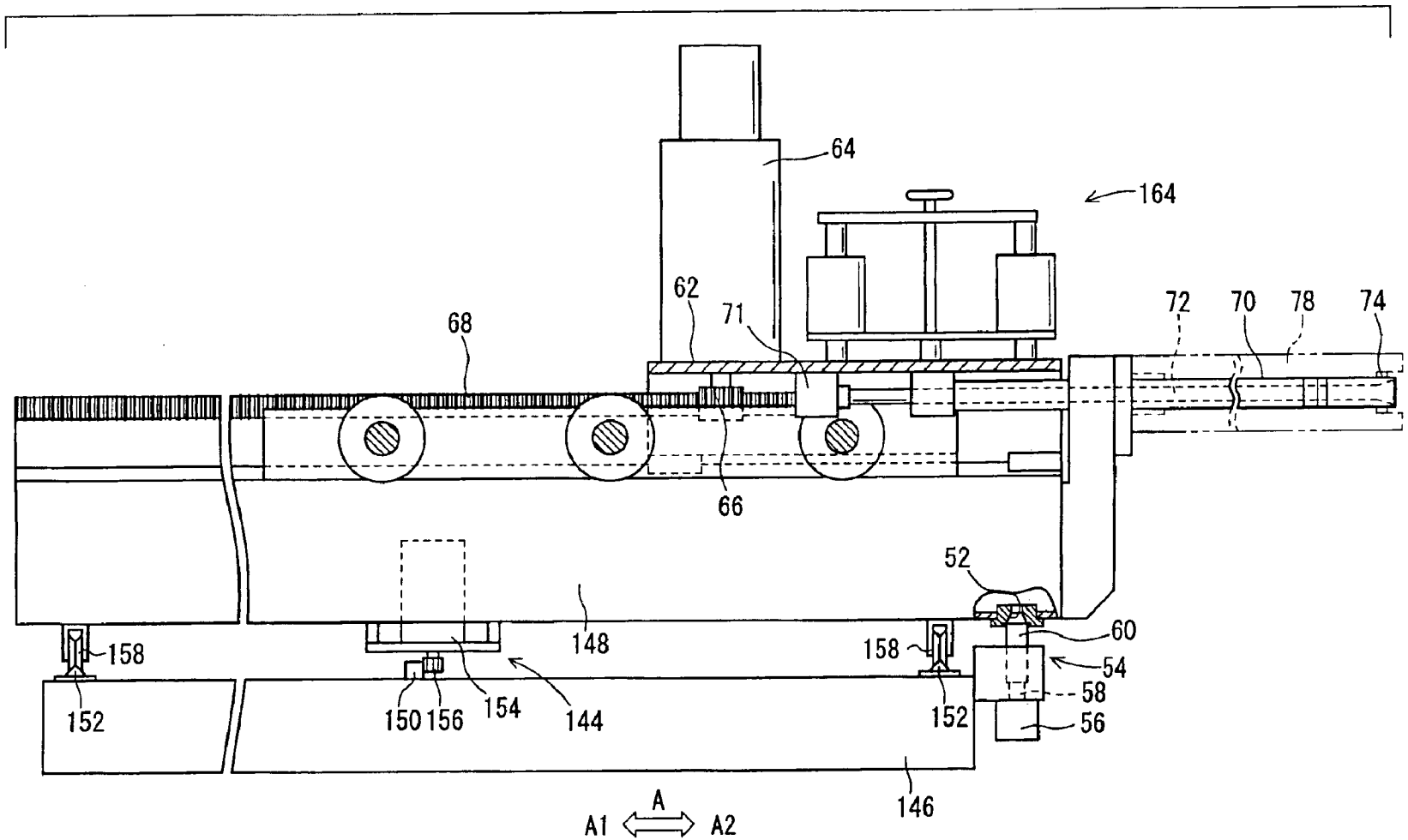
FIG. 10 is a side elevational view of a workpiece withdrawal device of the centrifugal casting apparatus shown in FIG. 8.

The unit drive mechanism 144 has a frame 146 on which there is disposed a unit table 148 supporting thereon a central rack 150 and a pair of guide rails 152 positioned one on each side of the central rack 150. The rack 150 and the guide rails 152 extend in the direction B. As shown in FIGS. 9 and 10, a rotary actuator 154 is mounted on the lower surface of the unit table 148, and has a drive shaft supporting thereon a pinion 156 held in mesh with the rack 150. Rollers 158 are rotatably mounted on the lower surface of the unit table 148 and held in rolling engagement with the guide rails 152 for rolling movement in the direction B.

The lower surface of the unit table 148 has three engaging holes 52 defined in an end thereof in the axial direction A2 for positioning the unit table 148 with respect to the frame 146. The frame 146 has an engaging unit 54 mounted on an end thereof at a position aligned with the first and second cylindrical centrifugal casting molds 22*a*, 22*b*. The engaging unit 54 includes a vertical cylinder 56 having an upwardly extending rod 58 axially coupled to an engaging pin 60 for selectively engaging in the engaging holes 52.

The operating unit 142 comprises a first cleaning mechanism 162*a*, a workpiece withdrawal mechanism 164, a facing material applying mechanism 166, and a second cleaning mechanism 162*b* which are disposed parallel to each other in the axial direction A and juxtaposed in the direction B.

Adjacent two of the first cleaning mechanism 162*a*, the workpiece withdrawal mechanism 164, the facing material applying mechanism 166, and the second cleaning mechanism 162*b* are spaced from each other by an interval or distance P1 which is equal to an interval or distance P2 between the first and second cylindrical centrifugal casting molds 22*a*, 22*b*.

As shown in FIGS. 8 and 9, each of the first and second cleaning mechanisms 162*a*, 162*b* has a rack 170 extending in the axial direction A and fixedly mounted on the unit table 148. A first movable base 172 is mounted on the unit table 148 so as to be movable back and forth in the axial direction A. A rotary actuator 174 is vertically fixedly mounted on the first movable base 172 and has a downwardly extending drive shaft on which there is mounted a pinion 176 held in mesh with the rack 170. The first movable base 172 supports thereon a rod 178 extending horizontally in the axial direction A, and a horizontally elongate brush 180 is coupled to the tip end of the rod 178.

As shown in FIG. 8, the facing material applying mechanism 166 has a rack 202 fixedly mounted on the unit table 148 and extending in the axial direction A, and a third movable base 204 disposed on the unit table 148 and movable back and forth in the axial direction A. The third movable base 204 supports thereon a rotary actuator 206 vertically fixedly mounted thereon and having a downwardly extending drive shaft on which there is mounted a pinion 208 held in mesh with the rack 202.

The third movable base 204 supports thereon a small-diameter nozzle tube 210 which is elongate in the axial direction A. The nozzle tube 210 has a plurality of ejection ports 212 defined in its circumferential wall at spaced intervals.

Operation of the centrifugal casting apparatus 140 thus constructed will be described below with reference to FIGS. 11 and 12.

Figure 13:
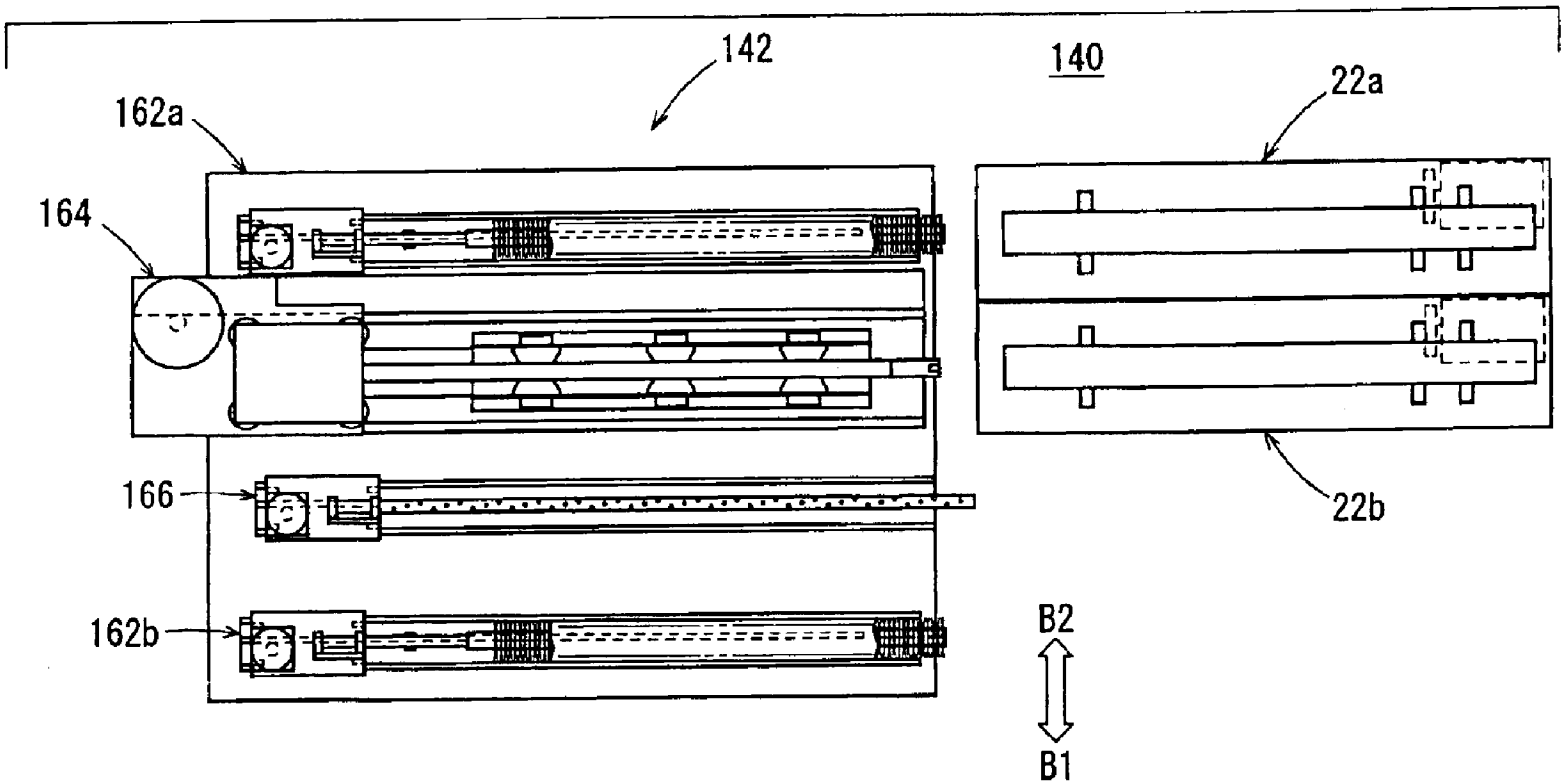
FIG. 13 is a view illustrative of a process of cleaning a first centrifugal casting mold of the centrifugal casting apparatus shown in FIG. 8.

With the operating unit 142 located in a position shown in FIG. 13, the first cleaning mechanism 162*a* cleans the inner wall surface of the first centrifugal casting mold 22*a* in step S11. As shown in FIG. 9, the rotary actuator 174 of the first cleaning mechanism 162*a* rotates the pinion 176 to cause the first movable base 172 in the direction A2 along the rack 170 held in mesh with the pinion 176. The rod 178 held by the first movable base 172 moves in the direction A2, inserting the brush 180 coupled to the tip end of the rod 178 into the first centrifugal casting mold 22*a*. The brush 180 then cleans the inner wall surface of the first centrifugal casting mold 22*a*.

After having cleaned the inner wall surface of the first centrifugal casting mold 22*a*, the brush 180 is moved in the direction A1 by the rotary actuator 174 away from the first centrifugal casting mold 22*a*. The first centrifugal casting mold 22*a* is then cooled in step S12, after which a cap (not shown) is attached to the first centrifugal casting mold 22*a* in step S13.

Figure 14:
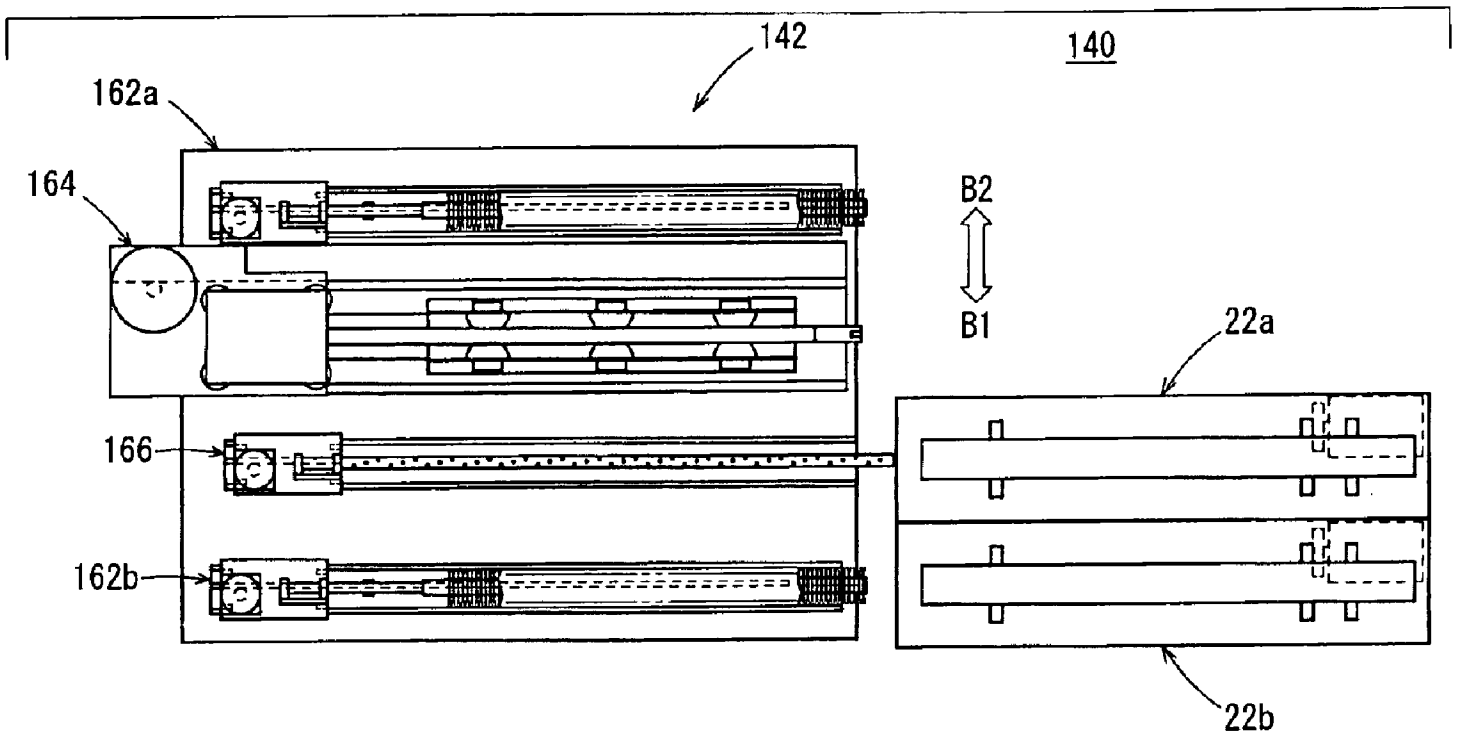
FIG. 14 is a view illustrative of a process of coating the first centrifugal casting mold with a facing material and a process of cleaning a second centrifugal casting mold of the centrifugal casting apparatus shown in FIG. 8.

The rotary actuator 154 of the unit drive mechanism 144 is actuated to cause the pinion 156 and the rack 150 to move the unit table 148 on the frame 146 in the direction B2. The facing material applying mechanism 166 is now brought into alignment with the first centrifugal casting mold 22*a*, as shown in FIG. 14.

As shown in FIG. 8, the rotary actuator 206 of the facing material applying mechanism 166 is energized to cause the pinion 208 and the rack 202 to move the third movable base 204 in the direction A2. The nozzle tube 210 is inserted into the first centrifugal casting mold 22*a*. Then, a facing material (not shown) is ejected from the ejection ports 212 of the nozzle tube 210 and applied to the inner wall surface of the first cylindrical centrifugal casting mold 22*a* in step S14.

Then, the nozzle tube 210 is removed by the rotary actuator 206 from the first cylindrical centrifugal casting mold 22*a*, which is thereafter dried in step S15. The first cylindrical centrifugal casting mold 22*a* can well be dried when it is rotated.

When a given amount of molten metal has been supplied to the pouring mechanism 32, the slide base 122 of the pouring mechanism 32 is moved in the direction A1 to locate the trough 124 in a pouring position for the first cylindrical centrifugal casting mold 22*a*. After the trough 124 pours the molten metal into the first cylindrical centrifugal casting mold 22*a* in step S16, the slide base 122 is retracted in the direction A2, and the rotary actuator 34*a* is energized. The first cylindrical centrifugal casting mold 22*a* keeps being rotated by the rotor 33*a* and the support 35*a* in step S17. The molten metal in the first cylindrical centrifugal casting mold 222 is solidified into a cylindrical casting 78.

Figure 15:
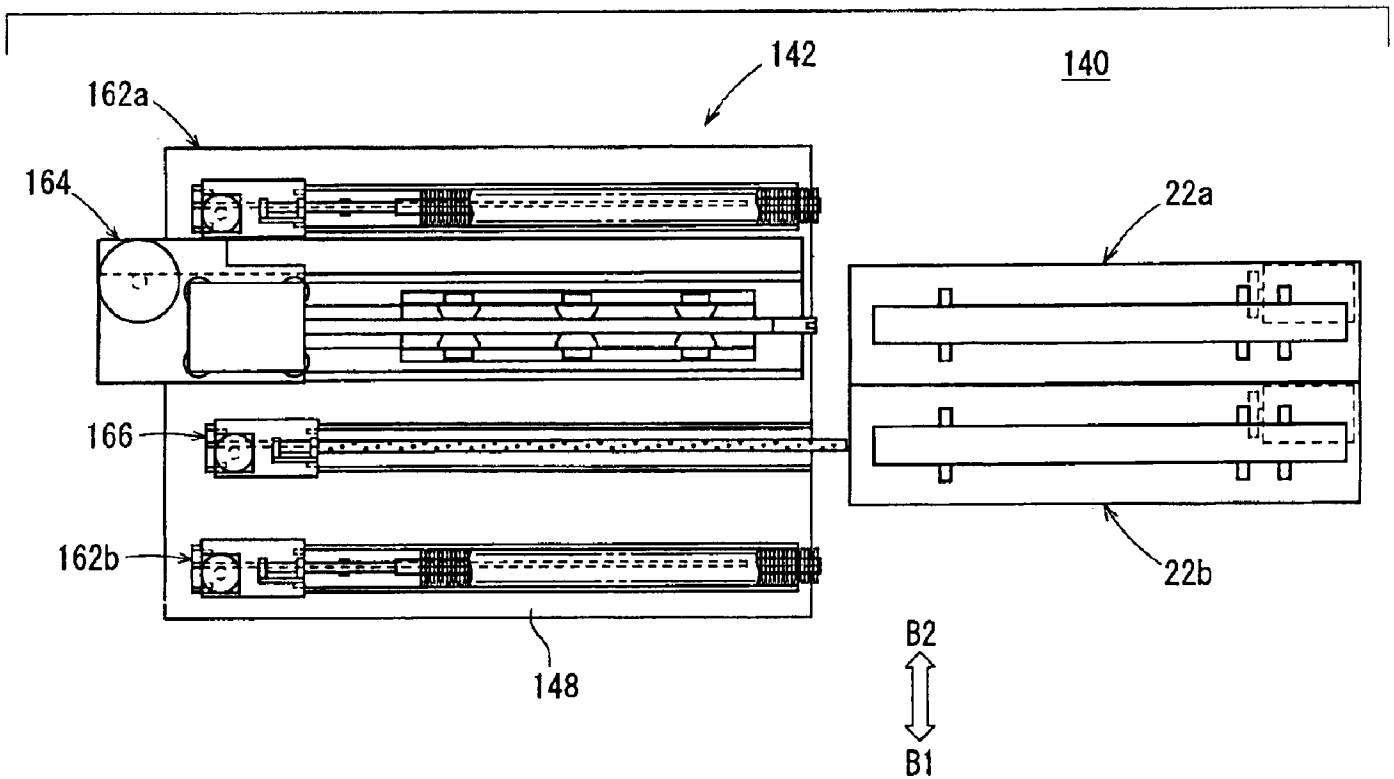
FIG. 15 is a view illustrative of a process of coating the second centrifugal casting mold with a facing material.

While the first cylindrical centrifugal casting mold 22*a* keeps being rotated, the non-illustrated cap is removed from the first cylindrical centrifugal casting mold 22*a* in step S18. The workpiece withdrawal mechanism 164 is moved into alignment with the first cylindrical centrifugal casting mold 22*a* as shown in FIG. 15. In the workpiece withdrawal mechanism 164, the rotary actuator 154 of the unit drive mechanism 144 is energized to cause the pinion 156 and the rack 150 to move the unit table 148 in the direction B1. When the workpiece withdrawal mechanism 164 reaches a position aligned with the first cylindrical centrifugal casting mold 22*a*, the unit table 148 is stopped as shown in FIG. 15.

The rotary actuator 34*a* is then de-energized, and the rotary actuator 64 is energized to cause the pinion 66 and the rack 68 to move the first movable base 62 in the direction A2 as shown in FIG. 10. The cylindrical member 70 mounted on the first movable base 62 is inserted into the cylindrical casting 78 which is cast in the first cylindrical centrifugal casting mold 22*a*, and moved in the direction A2 until the openable/closable chuck 74 is located at the tip end of the cylindrical casting 78 in the direction A2.

Then, the opening and closing cylinder 76 is actuated to cause the drive rod 72 to open the openable/closable chuck 74. The rotary actuator 64 is energized again to move the first movable base 62 in the direction A1. The openable/closable chuck 74 which is open engages the tip end of the cylindrical casting 78, and pulls the cylindrical casting 78 from the first cylindrical centrifugal casting mold 22*a* in step S19.

After the cylindrical casting 78 is withdrawn from the first cylindrical centrifugal casting mold 22*a*, the unit drive mechanism 144 is actuated to move the unit table 148 in the direction B1 to bring the cleaning mechanism 162*a* into alignment with the first cylindrical centrifugal casting mold 22*a*.

In the third embodiment, as described above, while a cylindrical casting 78 is being cast in the first cylindrical centrifugal casting mold 22*a*, another cylindrical casting 78 is synchronously cast in the second cylindrical centrifugal casting mold 22*b*.

Figure 12:
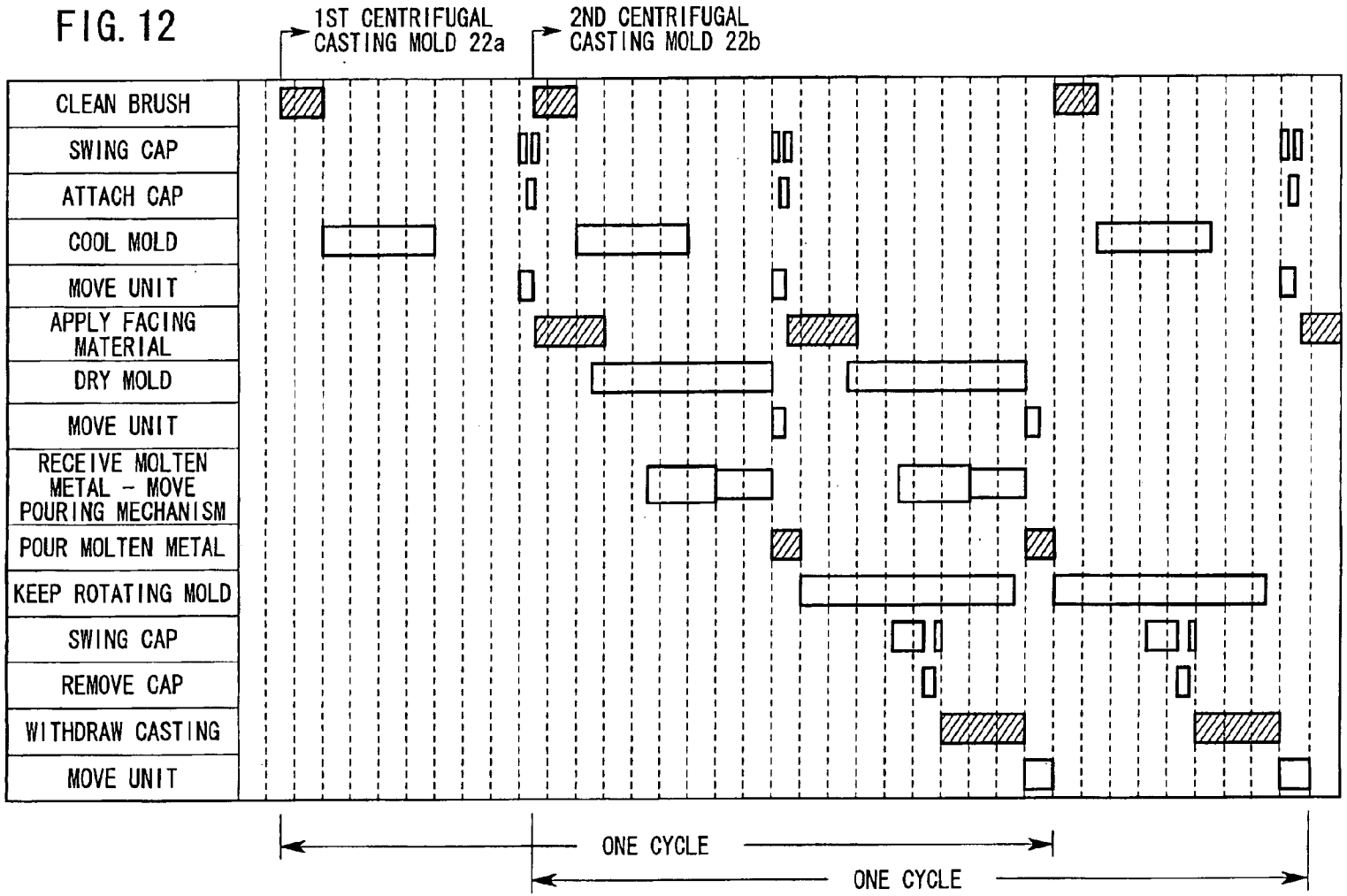
FIG. 12 is a diagram showing an operation program of the centrifugal casting apparatus shown in FIG. 8.

Specifically, as shown in FIGS. 12 and 14, at the same time that the facing material applying mechanism 166 applies a facing material to the inner wall surface of the first cylindrical centrifugal casting mold 22*a*, the second cleaning mechanism 162*b* cleans the second cylindrical centrifugal casting mold 22*b*. As with the first cleaning mechanism 162*a*, the second cleaning mechanism 162*b* cleans the inner wall surface of the second cylindrical centrifugal casting mold 22*b* with the brush 180 which is moved in the direction A2 by the rotary actuator 174.

Figure 11:
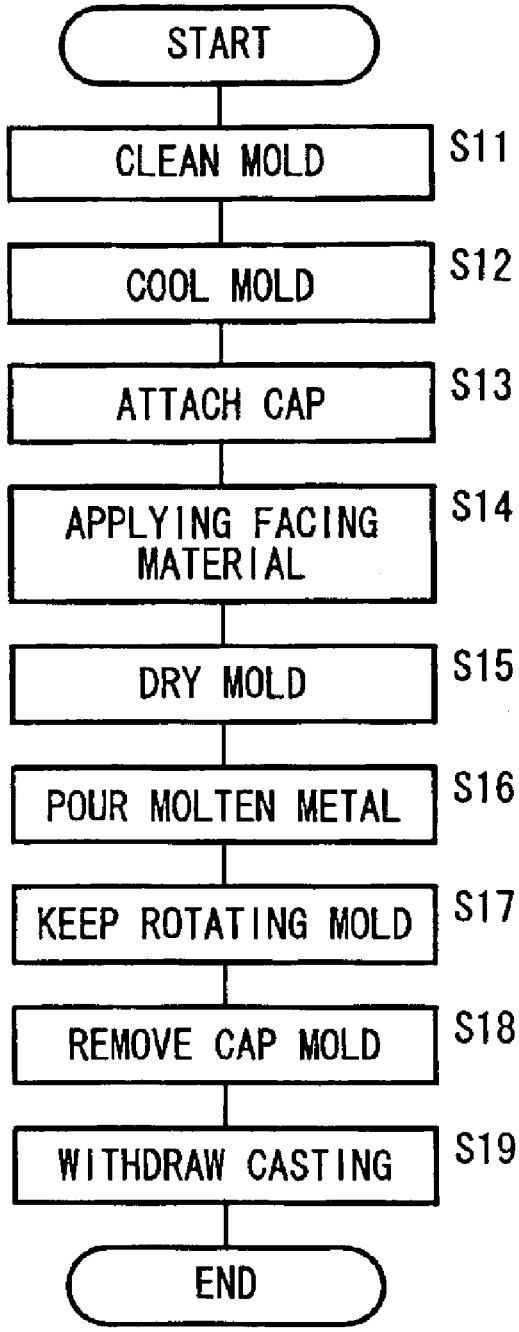
FIG. 11 is a flowchart of a centrifugal casting process carried out by the centrifugal casting apparatus shown in FIG. 8.

The second cylindrical centrifugal casting mold 22*b* carries out its centrifugal casting process in the same manner as with the first cylindrical centrifugal casting mold 22*a* according to the flowchart shown in FIG. 11. After the second cleaning mechanism 162*b* cleans the second cylindrical centrifugal casting mold 22*b*, the facing material applying mechanism 166 applies a facing material to the inner wall surface of the second cylindrical centrifugal casting mold 22*b*. Then, the pouring mechanism 32 pours the molten metal into the second cylindrical centrifugal casting mold 22*b*. Thereafter, the workpiece withdrawal mechanism 164 withdraws a cylindrical casting 78 produced in the second cylindrical centrifugal casting mold 22*b*.

According to the third embodiment, as described above, the operating unit 142 has the first and second cleaning mechanism 162*a*, 162*b*, the workpiece withdrawal mechanism 164, and the facing material applying mechanism 166 for working on the first and second centrifugal casting molds 22*a*, 22*b*. The centrifugal casting apparatus 140 according to the third embodiment, therefore, has one workpiece withdrawal mechanism 164 and one facing material applying mechanism 166 less than a centrifugal casting apparatus which has two sets of basic units including a workpiece withdrawal mechanism, a cleaning mechanism, and a facing material applying mechanism, for working on the first and second centrifugal casting molds 22*a*, 22*b*.

As shown in FIG. 8, the second cleaning mechanism 162*b*, the facing material applying mechanism 166, the workpiece withdrawal mechanism 164, and the first cleaning mechanism 162*a* are successively arranged in the named order in the direction B2, i.e., in a sequence of successive steps. Thus, the first and second cleaning mechanisms 162*a*, 162*b* which are relatively inexpensive are disposed one on each side of the facing material applying mechanism 166.

Consequently, an overall installation space for the centrifugal casting apparatus 140 is effectively reduced, the cost of the equipment thereof is lowered, and hence the centrifugal casting apparatus 140 is economical. While it may be proposed to dispense with the second cleaning mechanism 162*b* and use two facing material applying mechanisms 166, no advantages are obtained as the cycle time of the facing material applying process is short, and the cost of the equipment required tends to be high as the facing material applying mechanisms 166 are expensive. According to the third embodiment, therefore, the first and second cleaning mechanisms 162*a*, 162*b* are used to reduce the total cost of the centrifugal casting apparatus 140.

According to the third embodiment, furthermore, at the same time that the facing material is applied to the inner wall surface of the first centrifugal casting mold 22*a*, the inner wall surface of the second centrifugal casting mold 22*b* is cleaned. Accordingly, desired centrifugal casting processes are efficiently performed by the first and second centrifugal casting molds 22*a*, 22*b*.

Moreover, the operating unit 142 is disposed on axial side of the first and second centrifugal casting molds 22*a*, 22*b*, i.e., in the direction A1, and the pouring mechanism 32 is disposed on the other axial side of the first and second centrifugal casting molds 22*a*, 22*b*, i.e., in the direction A2.

Therefore, the first and second cleaning mechanisms 162*a*, 162*b*, the workpiece withdrawal mechanism 164, and the facing material applying mechanism 166 are spaced from the pouring mechanism 32, and are not susceptible to the heat from the pouring mechanism 32.

The first and second cleaning mechanisms 162*a*, 162*b*, the workpiece withdrawal mechanism 164, and the facing material applying mechanism 166, which are relatively long and mounted on the unit table 148, are oriented in the same direction and disposed parallel to each other, and the pouring mechanism 32, which is relatively short, is disposed alone. The centrifugal casting apparatus 140 thus offers the same advantages as the centrifugal casting apparatus 20 according to the first embodiment.

Figure 16:
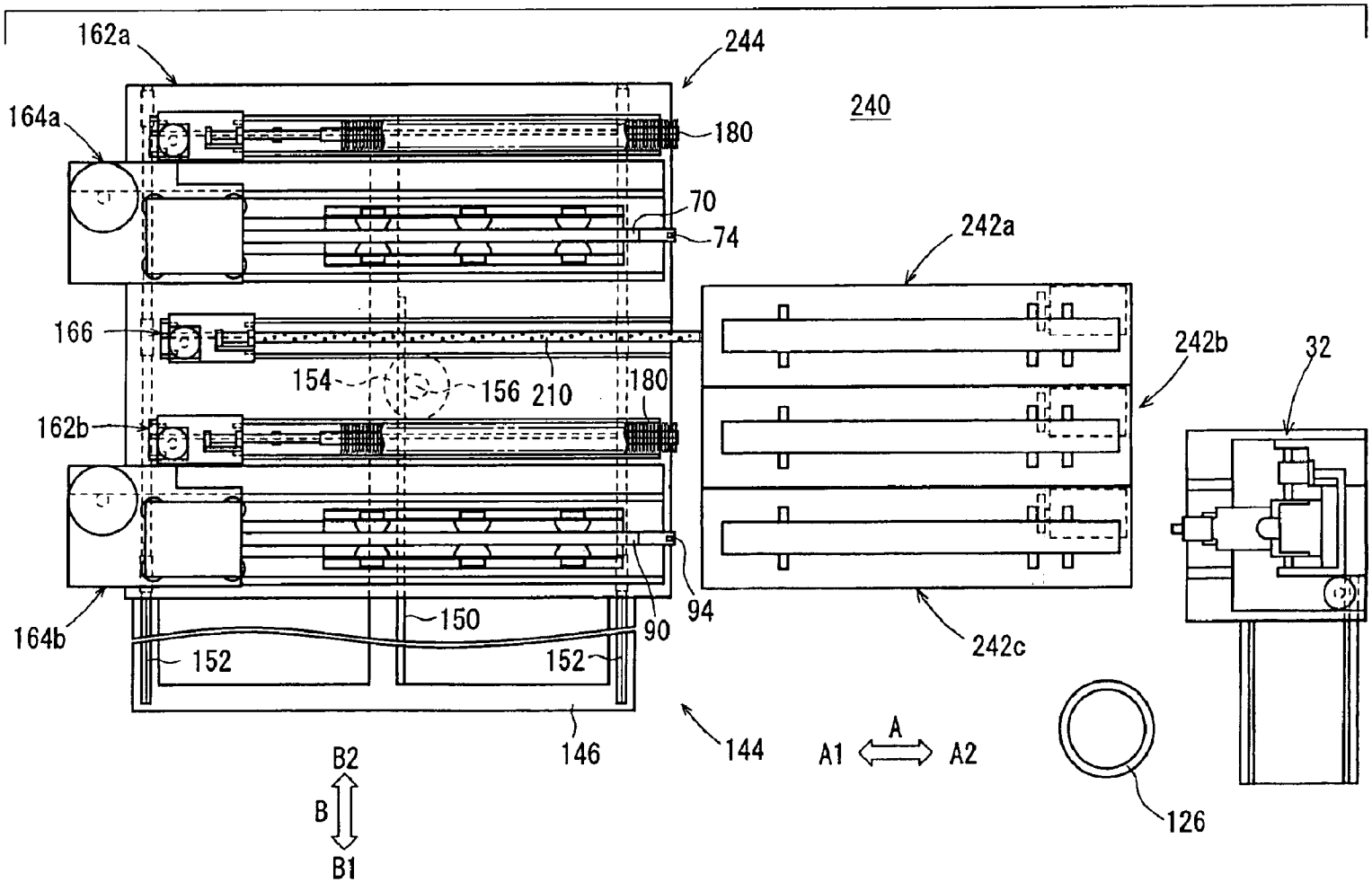
FIG. 16 is a schematic plan view of a centrifugal casting apparatus according to a fourth embodiment of the present invention.

FIG. 16 schematically shows in plan a centrifugal casting apparatus 240 according to a fourth embodiment of the present invention.

As shown in FIG. 16, the centrifugal casting apparatus 240 comprises first, second, and third centrifugal casting molds 242*a*, 242*b*, 242*c* which are axially parallel to each other in the axial direction A and juxtaposed in the direction B, an operating unit 244 disposed on one axial side of the first, second, and third centrifugal casting molds 242*a*, 242*b*, 242*c*, i.e., in the direction A1, a unit drive mechanism 144 for moving the operating unit 142 in the direction B, and a pouring mechanism 32 disposed on the other axial side of the first, second, and third centrifugal casting molds 242*a*, 242*b*, 242*c*, i.e., in the direction A2.

The operating unit 244 comprises a first cleaning mechanism 162*a*, a first workpiece withdrawal mechanism 164*a*, a facing material applying mechanism 166, a second cleaning mechanism 162*b*, and a second workpiece withdrawal mechanism 164*b* which are disposed parallel to each other in the axial direction A and juxtaposed in the direction B.

Figure 17:
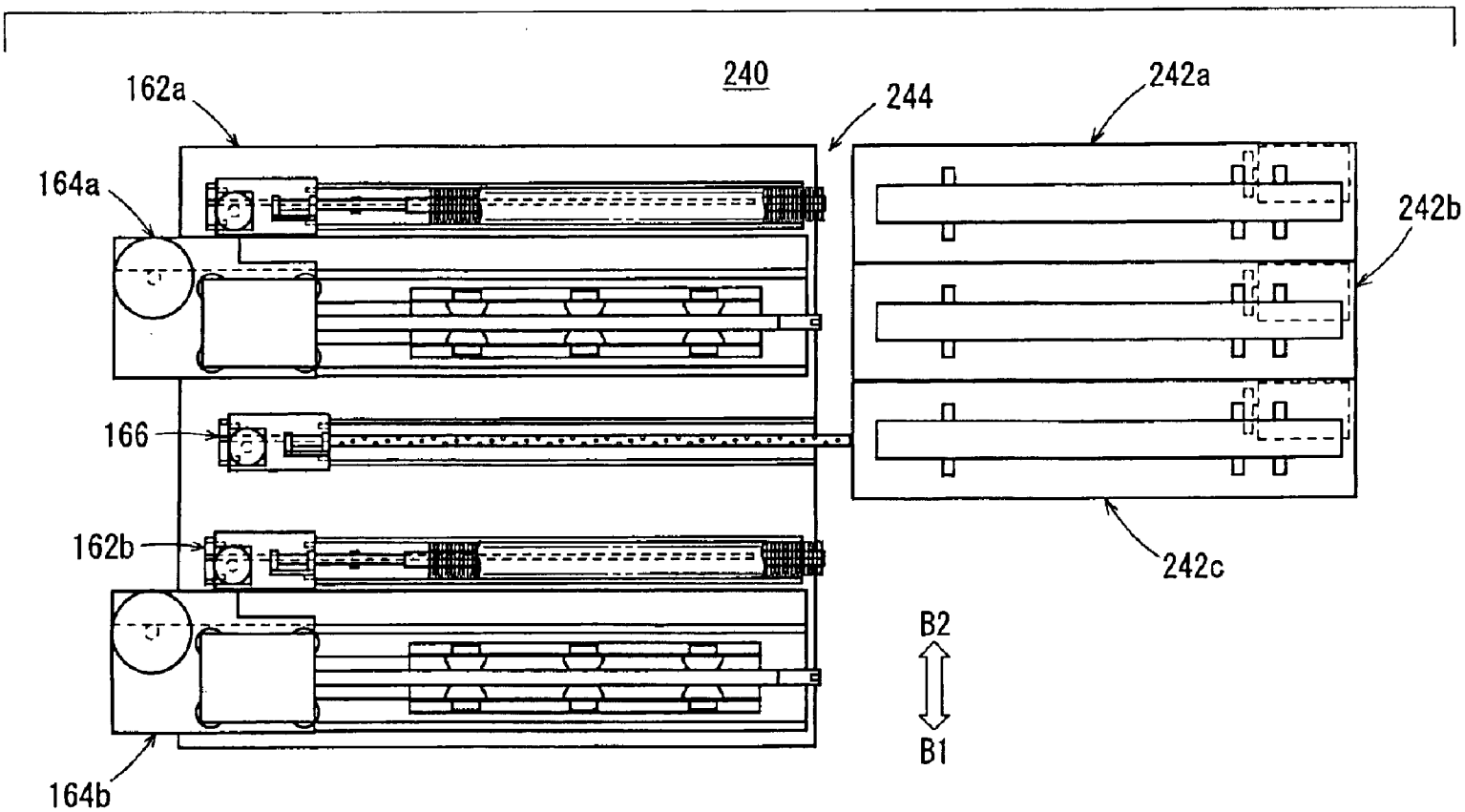
FIG. 17 is a view illustrative of a process of cleaning a first centrifugal casting mold of the centrifugal casting apparatus shown in FIG. 16.

The centrifugal casting apparatus 240 according to the fourth embodiment operates as follows: When the operating unit 244 is located in a position shown in FIG. 17, the first cleaning mechanism 162*a* cleans the first centrifugal casting mold 242*a*, the first workpiece withdrawal mechanism 164*a* withdraws a produced cylindrical casting from the second centrifugal casting mold 242*b*, and the facing material applying mechanism 166 applies a facing material to the third centrifugal casting mold 242*c*.

Figure 18:
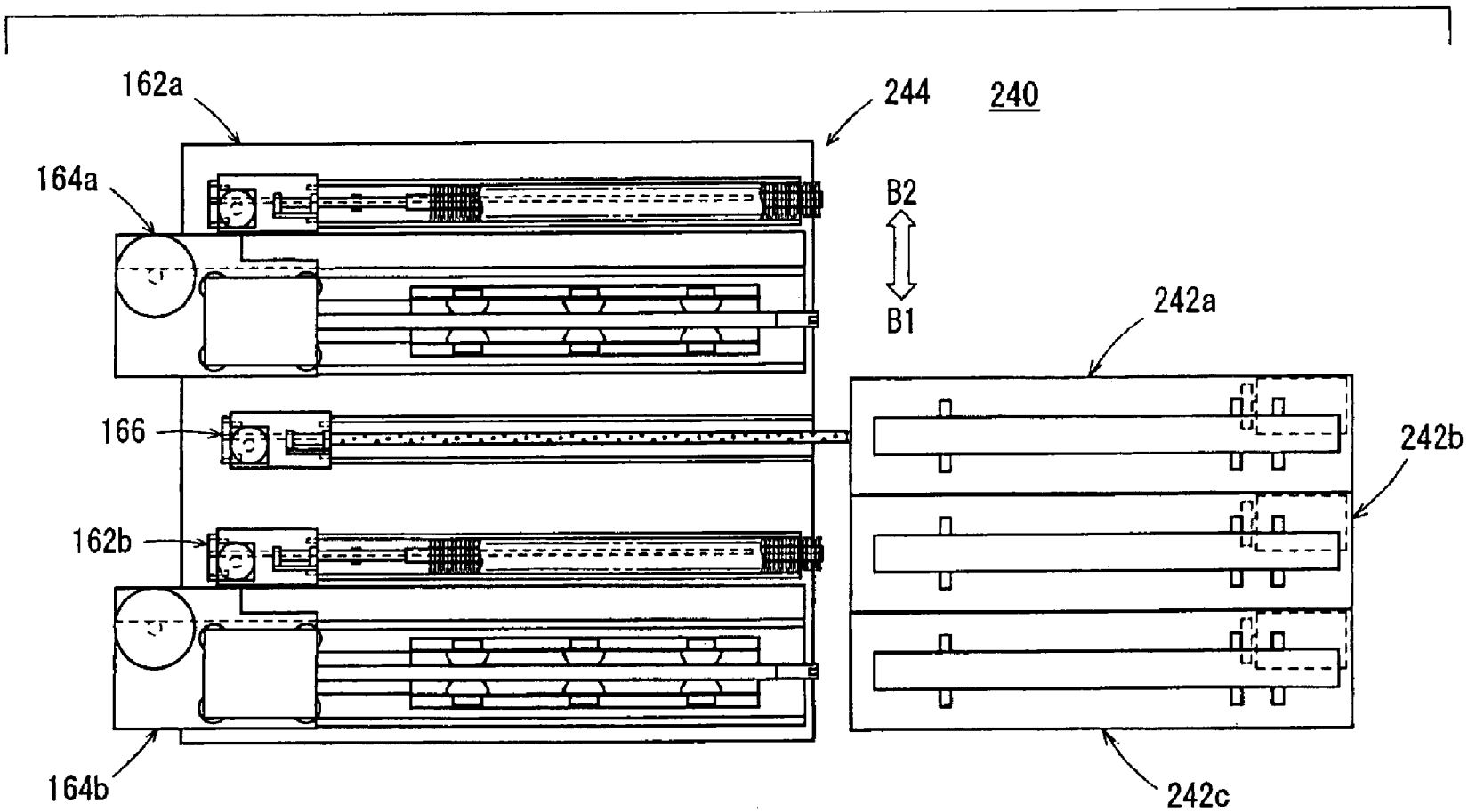
FIG. 18 is a view illustrative of a process of coating the first centrifugal casting mold with a facing material.

When the operating unit 244 is located in a position shown in FIG. 18, the facing material applying mechanism 166 applies a facing material to the first centrifugal casting mold 242*a*, the second cleaning mechanism 162*b* cleans the second centrifugal casting mold 242*b*, and the second workpiece withdrawal mechanism 164*b* withdraws a produced cylindrical casting from the third centrifugal casting mold 242*c*.

Figure 19:
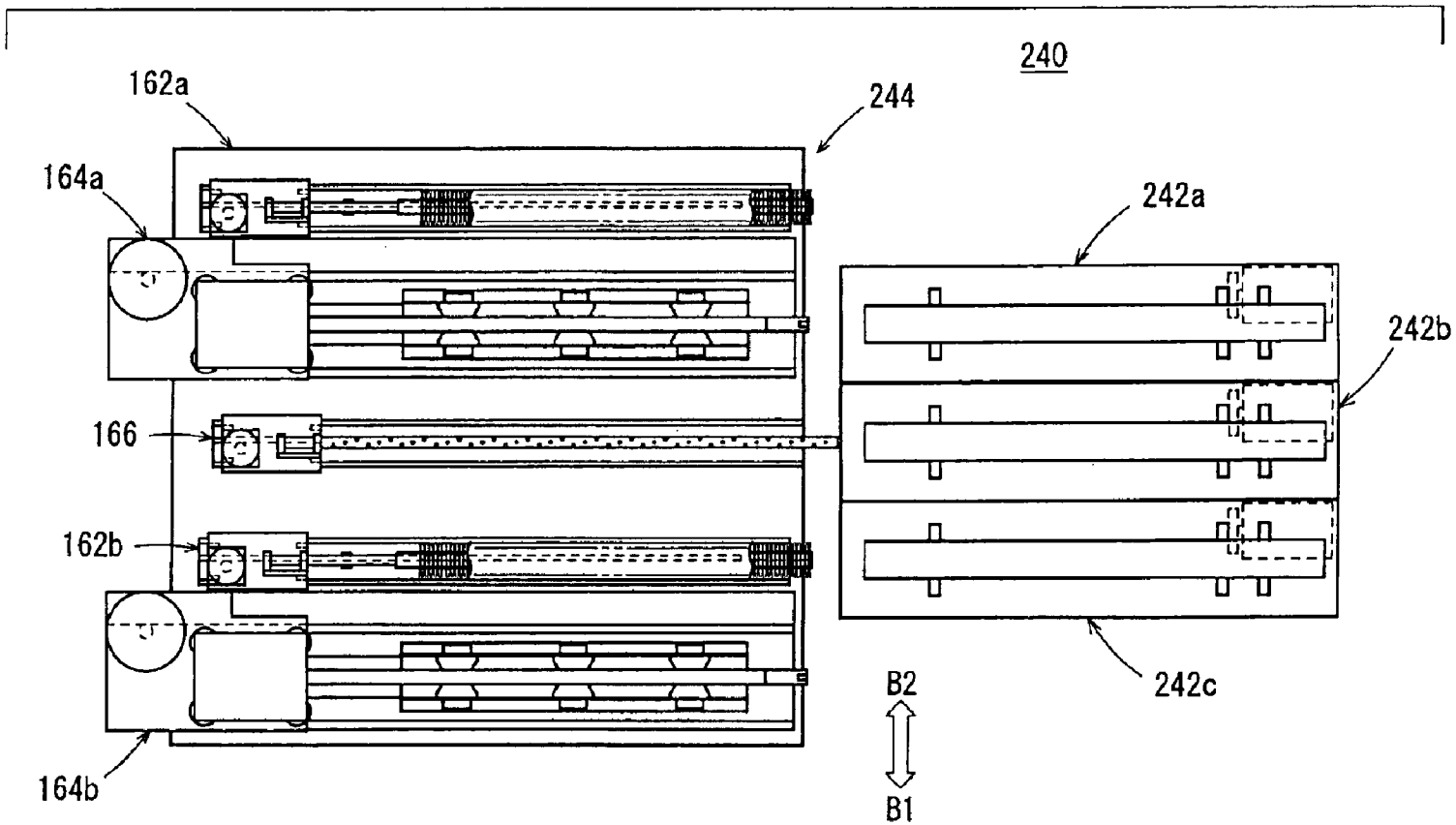
FIG. 19 is a view illustrative of a process of withdrawing a workpiece from the first centrifugal casting mold.
Figure 20:
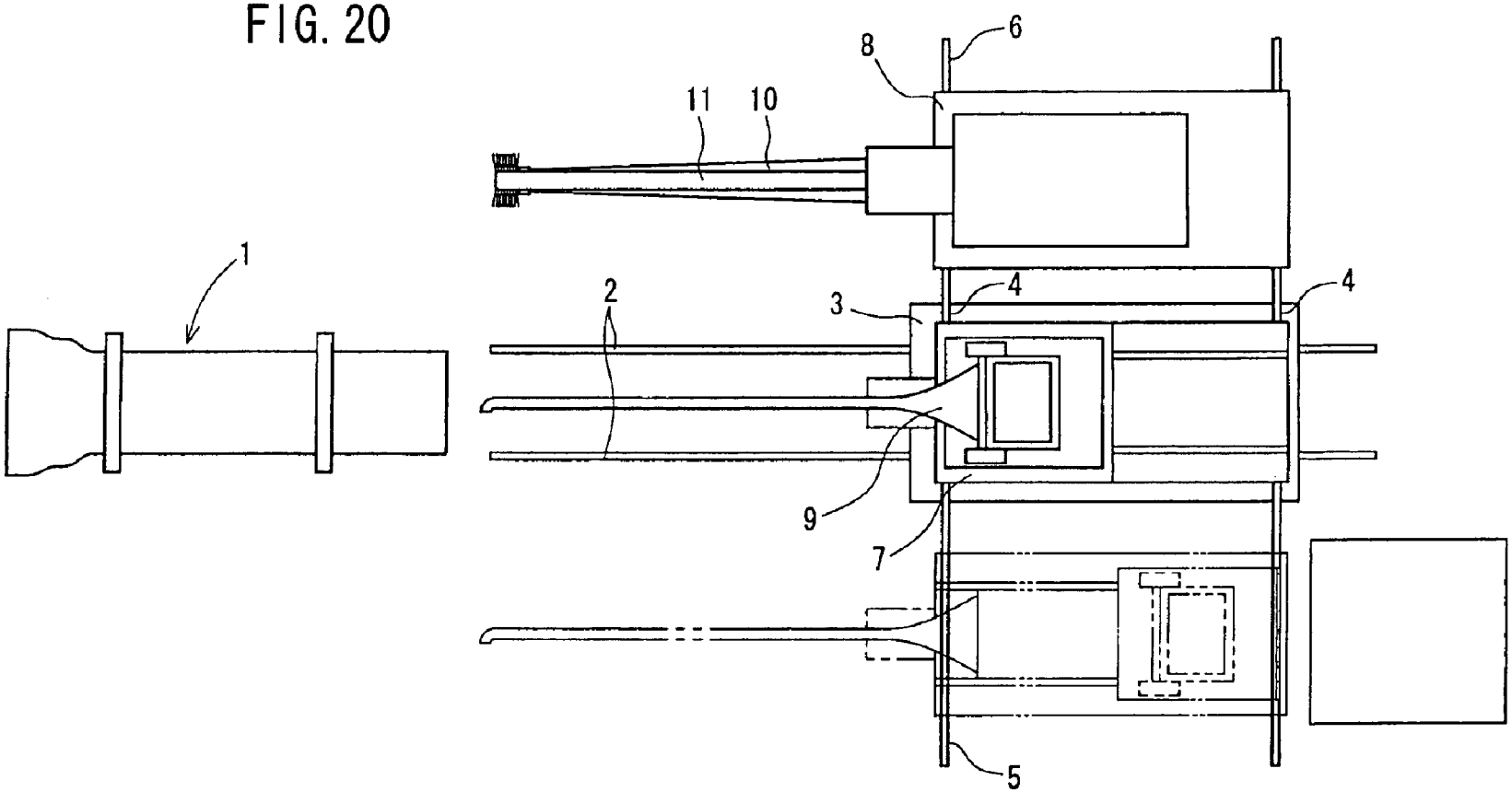
FIG. 20 is a schematic plan view of a conventional centrifugal casting apparatus.

When the operating unit 244 is located in a position shown in FIG. 19, the first workpiece withdrawal mechanism 164*a* withdraws a produced cylindrical casting from the first centrifugal casting mold 242*c*, the facing material applying mechanism 166 applies a facing material to the second centrifugal casting mold 242*b*, and the second cleaning mechanism 162*b* cleans the third centrifugal casting mold 242*c*.

According to the fourth embodiment, therefore, the operating unit 244 which as the first and second cleaning mechanisms 162*a*, 162*b*, the first and second workpiece withdrawal mechanisms 164*a*, 164*b*, and the facing material applying mechanism 166 is capable of working on the first, second, and third centrifugal casting molds 242*a*, 242*b*, 242*c*. As shown in FIG. 16, the second workpiece withdrawal mechanism 164*b*, the second cleaning mechanism 162*b*, the facing material applying mechanism 166, the first workpiece withdrawal mechanism 164*a*, and the first cleaning mechanism 162*a* are successively arranged in the named order in the direction B2, i.e., in a sequence of successive steps. Thus, the centrifugal casting apparatus 240 may have only one facing material applying mechanism 166 which is of a relatively high equipment cost, among other mechanisms.

The centrifugal casting apparatus 240 according to the fourth embodiment, therefore, has one workpiece withdrawal mechanism, one cleaning mechanism, and two facing material applying mechanisms less than a centrifugal casting apparatus which has a workpiece withdrawal mechanism, a cleaning mechanism, and a facing material applying mechanism, dedicated to each of the first, second, and third centrifugal casting molds 242*a*, 242*b*, 242*c*. Consequently, an overall installation space for the centrifugal casting apparatus 240 is effectively reduced, and the cost of the equipment thereof is greatly lowered.

In the fourth embodiment, the centrifugal casting apparatus 240 has the first, second, and third centrifugal casting molds 242*a*, 242*b*, 242*c*. However, a centrifugal casting apparatus may have four or more centrifugal casting molds.

Industrial Applicability

With the centrifugal casting apparatus according to the present invention, the workpiece withdrawal mechanism, the cleaning mechanism, and the facing material applying mechanism are not susceptible to the heat from the pouring mechanism, and their positioning accuracy can effectively be maintained with a simple arrangement. Since the workpiece withdrawal mechanism, the cleaning mechanism, and the facing material applying mechanism, which are relatively long, are juxtaposed, the centrifugal casting apparatus is compact as a whole, and an installation space therefor is effectively utilized with ease.

With the centrifugal casting apparatus according to the present invention, the operating unit has three types of mechanism, i.e., the workpiece withdrawal mechanism, the cleaning mechanism, and the facing material applying mechanism for two or more centrifugal casting molds. At least one of three types includes two mechanisms. Accordingly, the equipment of the centrifugal casting apparatus is effectively reduced, an installation space therefor is reduced, and the cost thereof is lowered. The centrifugal casting apparatus is thus highly economical.

What is claimed is:

1. A centrifugal casting apparatus comprising:

a centrifugal casting mold;

a workpiece withdrawal mechanism for pulling a workpiece out of said centrifugal casting mold, a cleaning mechanism for cleaning said centrifugal casting mold, and a facing material applying mechanism for coating said centrifugal casting mold with a facing material, said workpiece withdrawal mechanism, said cleaning mechanism, and said facing material applying mechanism being disposed parallel to each other on an axial side of said centrifugal casting mold in an axial direction thereof;

a unit drive mechanism for moving said workpiece withdrawal mechanism, said cleaning mechanism, and said facing material applying mechanism in unison with each other in a direction across to said axial direction; and a pouring mechanism disposed in an opposite axial side of said centrifugal casting mold.

2. A centrifugal casting apparatus according to claim 1, wherein said unit drive mechanism comprises:

a unit table, said workpiece withdrawal mechanism, said cleaning mechanism, and said facing material applying mechanism being mounted on said unit table; and an actuator for moving said unit table in said direction across to said axial direction.

3. A centrifugal casting apparatus according to claim 2, further comprising:

a frame on which said unit table is mounted;

said unit table having three engaging holes for positioning said workpiece withdrawal mechanism, said cleaning mechanism, and said facing material applying mechanism, respectively, with respect to said centrifugal casting mold;

said frame having an engaging unit for selectively engaging in said engaging holes.

4. A centrifugal casting apparatus according to claim 1, further comprising:

a drive mechanism for moving said pouring mechanism in said direction across to said axial direction; and a waste molten metal container for receiving a waste molten metal, positioned within a range in which said pouring mechanism is movable.

5. A centrifugal casting apparatus according to claim 1, wherein said centrifugal casting mold comprises first and second centrifugal casting molds disposed parallel to each other in said axial direction, said first and second centrifugal casting molds being spaced from each other by a distance which is equal to the distance between adjacent two of said workpiece withdrawal mechanism, said cleaning mechanism (26), and said facing material applying mechanism (28).

6. A centrifugal casting apparatus comprising:

at least two centrifugal casting molds disposed parallel to each other in an axial direction;

an operating unit comprising three types of mechanisms including a workpiece withdrawal mechanism for pulling a workpiece out of said centrifugal casting molds, a cleaning mechanism for cleaning said centrifugal casting molds, and a facing material applying mechanism for coating said centrifugal casting molds with a facing material, least one type of said three types including two mechanisms disposed parallel to each other on an axial side of said centrifugal casting molds in said axial direction;

a unit drive mechanism for moving said operating unit in a direction across to said axial direction; and a pouring mechanism disposed in an opposite axial side of said centrifugal casting molds.

7. A centrifugal casting apparatus according to claim 6, wherein said centrifugal casting molds include first and second centrifugal casting molds;

said operating unit including a first cleaning mechanism as said cleaning mechanism, said workpiece withdrawal mechanism, said facing material applying mechanism, and a second cleaning mechanism as said cleaning mechanism, adjacent two of said first cleaning mechanism, said workpiece withdrawal mechanism, said facing material applying mechanism, and said second cleaning mechanism being spaced from each other by a distance which is equal to the distance between said first and second centrifugal casting molds.

8. A centrifugal casting apparatus according to claim 6, wherein said centrifugal casting molds include first, second, and third centrifugal casting molds;

said operating unit including a first cleaning mechanism as said cleaning mechanism, a first workpiece withdrawal mechanism as said workpiece withdrawal mechanism, said facing material applying mechanism, a second cleaning mechanism as said cleaning mechanism, and a second workpiece withdrawal mechanism as said workpiece withdrawal mechanism, adjacent two of said first cleaning mechanism, said first workpiece withdrawal mechanism, said facing material applying mechanism, said second cleaning mechanism, and said second workpiece withdrawal mechanism being spaced from each other by a distance which is equal to the distance between adjacent two of said first, second, and third centrifugal casting molds.

9. A centrifugal casting apparatus according to claim 6, further comprising:

a drive mechanism for moving said pouring mechanism in said direction across to said axial direction; and a waste molten metal container for receiving a waste molten metal, positioned within a range in which said pouring mechanism is movable.

* * * * *